US007575300B2

(12) United States Patent
Kobayashi

(10) Patent No.: US 7,575,300 B2
(45) Date of Patent: Aug. 18, 2009

(54) INK CARTRIDGE ATTACHMENT/DETACHMENT DEVICE, RECORDING APPARATUS, AND LIQUID EJECTION APPARATUS

(75) Inventor: Satoshi Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 470 days.

(21) Appl. No.: 11/382,518

(22) Filed: May 10, 2006

(65) Prior Publication Data

US 2006/0256172 A1 Nov. 16, 2006

(30) Foreign Application Priority Data

May 11, 2005 (JP) ..... P2005-138299
Dec. 15, 2005 (JP) ..... P2005-362163

(51) Int. Cl.
*B41J 2/14* (2006.01)

(52) U.S. Cl. ..... 347/49

(58) Field of Classification Search ..... 347/37, 347/49, 85, 86, 87
See application file for complete search history.

(56) References Cited

U.S. PATENT DOCUMENTS 5,748,210 A * 5/1998 Watanabe et al. ..... 347/50
5,971,534 A * 10/1999 Sasaki et al. ..... 347/86
6,250,750 B1 * 6/2001 Miyazawa et al. ..... 347/87
6,435,663 B2 * 8/2002 Yamaguchi et al. ..... 347/49
6,779,880 B1 * 8/2004 Kulpa et al. ..... 347/86
7,455,397 B2 * 11/2008 Sakai et al. ..... 347/86
2004/0119799 A1 6/2004 Kulpa et al.

FOREIGN PATENT DOCUMENTS

EP 0 872 355 A2 10/1998
EP 0 872 355 A3 10/1998
EP 1 547 785 A2 6/2005
EP 1 547 785 A3 6/2005
JP 11-157094 A 6/1999

OTHER PUBLICATIONS

Extended European Search Report for European Patent Appln. No. 06009777.1 (Jan. 25, 2008).

* cited by examiner

*Primary Examiner*—Anh T. N. Vo
(74) *Attorney, Agent, or Firm*—Stroock & Stroock & Lavan LLP

(57) ABSTRACT

An ink cartridge attachment/detachment device 1 provided with an insertion opening 180 into which an ink cartridge 11 is inserted, and adapted to load the ink cartridge into a recording apparatus 3, includes: a cartridge holding unit 30, holding the ink cartridge 11 inserted from the insertion opening 180 in the recording apparatus; a lever arm 363, movable from a reset position at which the lever arm 363 is positioned when a loading of an ink cartridge 11 is enabled to a set position at which the lever arm 363 is positioned when the loading of the ink cartridge 11 is completed; a power transmitting and converting mechanism 32, converting a rotation of the lever arm 363 into a movement required for loading the ink cartridge 11 held by the cartridge holding unit 30; and an ink cartridge erroneous insertion action preventing unit 181, preventing an insertion action of the ink cartridge 11 when the lever arm 363 is not at the reset position.

13 Claims, 31 Drawing Sheets

PRIOR ART

PRIOR ART

PRIOR ART

INK CARTRIDGE ATTACHMENT/DETACHMENT DEVICE, RECORDING APPARATUS, AND LIQUID EJECTION APPARATUS

BACKGROUND OF THE INVENTION

1. Technical Field of the Invention

The present invention relates to an ink cartridge attachment/detachment device which loads an ink cartridge into a main body of a recording apparatus by sliding the ink cartridge, to a recording apparatus having such an attachment/detachment device, and to a liquid ejection apparatus having such an attachment/detachment device.

Such a liquid ejection apparatus includes not only a recording apparatus, such as an ink jet recording apparatus, a copier, or a facsimile machine, that ejects ink from a recording head serving as a liquid ejection head to record images on a recording material, but also an apparatus which ejects a liquid corresponding to an intended purpose, instead of ink, from a liquid ejection head, which corresponds to the recording head, onto an ejected liquid target material, which corresponds to the recording material, to attach liquid to the ejected liquid target material. In addition to the recording head, the liquid ejection head can be a color material ejection head used for manufacturing a color filter for a liquid crystal display, an electrode material (conductive paste) ejection head used for forming an electrode for an organic EL display or a surface emitting display (FED), a bio-organic ejection head used for manufacturing a bio-chip, or a sample ejection head which ejects a sample as a precision pipette.

2. Description of the Related Art

A description will now be given for an ink jet printer as an example of an ink jet recording apparatus or a liquid ejection apparatus. A comparatively large pressing force is required to load an ink cartridge into an ink jet printer. When separate ink cartridges are provided for individual colors, the pressing force of about 4.9 to 6.9 N is sufficient. However, since a single package type ink cartridge with ink cartridges for a plurality of colors integrally formed includes a plurality of needles are provided, for example, in case of six colors, seven needles (for six colors and a waste ink tank) are provided, a very large pressing force of 34.3 to 48.3 N is required. Such a large pressing force can be exerted so long as the ink cartridge is loaded vertically. However, when the ink cartridge is loaded by sliding the ink cartridge in a horizontal direction, an unnatural force is also imposed on the ink jet printer. Accordingly, the application of a large pressing force is practically impossible.

Disclosed in JP-A-11-157094 is an ink cartridge attachment/detachment device that uses leverage principle to obtain a large pressing force. According to this device, the rotation of a cartridge attachment/detachment lever is transmitted to a link plate to enable unlocking of a link lever and loading of an ink cartridge into a holder. However, the ink cartridge attachment/detachment device does not include a cartridge holding unit which holds the ink cartridge when the ink cartridge is inserted, and thus the erroneous insertion of the ink cartridge does not occur from the start. A recording apparatus having a cartridge holding unit according to the related art will now be shown, and the problems in the related art will be described.

Here, 'insertion of ink cartridge' means that the ink cartridge is inserted into the recording apparatus from the outside and held by the cartridge holding unit. Further, 'erroneous insertion of ink cartridge' means that the ink cartridge is inserted but is not normally held by the cartridge holding unit.

FIGS. 21 to 25B show a recording apparatus having a cartridge holding unit and an ink cartridge erroneous insertion preventing unit in the related art.

FIG. 21 is a rear perspective view showing an ink cartridge attachment/detachment device when a lever arm is located at a reset position at which insertion of the ink cartridge is enabled. FIG. 22 is a rear perspective view showing an ink cartridge attachment/detachment device when a lever arm is located at a set position at which the lever arm is supposed to be when loading of the ink cartridge is completed.

FIG. 23 is a perspective view showing an ink cartridge erroneous insertion preventing unit on a magnified scale as obliquely viewed from below. FIGS. 24A and 24B are bottom views showing the operation states of an ink cartridge erroneous insertion preventing unit upon typical insertion of the ink cartridge. FIGS. 25A and 25B are bottom views showing the operation states of an ink cartridge erroneous insertion preventing unit upon erroneous insertion of the ink cartridge.

As shown in FIG. 21, an ink cartridge attachment/detachment device 500 is provided at a lower portion of a recording apparatus. The ink cartridge attachment/detachment device 500 includes a pair of left and right cartridge holding units 530. The cartridge holding units 530 are the same as cartridge holding units 30 of this invention, and thus the detailed description will be omitted. Herein, only a simple description will be given.

An insertion opening 580 into which an ink cartridge 511 is inserted is provided in the ink cartridge attachment/detachment device 500. When a lever arm 563 is located at a position shown in FIG. 21, the ink cartridge 511 is inserted into the insertion opening 580 by a first predetermined stroke and held by the cartridge holding unit 530 (30). Then, as shown in FIG. 22, a knob 563*a* of the lever arm 563 is moved to the right side in the drawing, and rotation of the lever arm 563 causes the cartridge holding unit 530 to be moved by a second predetermined stroke required for loading the ink cartridge 511 through a power transmitting and converting mechanism 532.

As shown in FIG. 22, when the lever arm 563 is located at a right position, that is, at a position other than the reset position, the cartridge holding unit 530, which is an internal structure, cannot receive the ink cartridge 511 even if the ink cartridge 511 is inserted. In this state, if the ink cartridge 511 is inserted, the ink cartridge 511 is not normally held by the cartridge holding unit 530. This is referred to as 'erroneous insertion of ink cartridge'. If the ink cartridge 511 is forcibly loaded from the 'erroneous insertion of ink cartridge' state, the internal structure may be damaged. This is referred to as 'erroneous loading of ink cartridge'.

Accordingly, in the related art, as shown in FIG. 23, ink cartridge erroneous insertion preventing units 501 are provided in the ink cartridge attachment/detachment device 500. The ink cartridge erroneous insertion preventing units 501 prevent the erroneous insertion of the ink cartridge 511 when the lever arm 563 is located at a set position shown in FIG. 22 at which the lever arm 563 is supposed to be when loading of the ink cartridge 511 is completed or when the lever arm 563 is located at a position other than a reset position shown in FIG. 21 at which loading of the ink cartridge 511 is enabled.

Specifically, as shown in FIG. 23, each of the ink cartridge erroneous insertion preventing units 501 includes an erroneous insertion preventing protrusion 502, a slide lock piece 548, and a guide groove 554. Here, the guide groove 554 is provided so as to be engaged with a guide protrusion 553 which is formed in the slide lock piece 548. Further, the slide lock piece 548 is provided so as to be engaged with an engagement concave portion 557 which is provided in the ink cartridge 511. In addition, pressing ribs 506 formed in the ink cartridge are provided so as to be brought into contact with lock sliders 536 in the ink cartridge attachment/detachment device when the ink cartridge 511 is inserted. The erroneous insertion protrusion 502 is a part formed so as to protrude toward the lock slider using a part of a subframe 560 which is a fixed frame 561 to be engaged with a main frame 562. Further, unlike an embodiment described below, the guide groove 554 has parallel portions 503 parallel to the insertion direction of the ink cartridge at a start end and a terminal end, as shown in FIGS. 24A to 25B. The parallel portion 503 at the start end is formed long, and the parallel portion 503 at the terminal end is formed short. Further, a slope portion 504 is formed to connect the parallel portions 504 at the start and terminal end. The length of the slope portion 503 is made considerably shorter than that in an embodiment described below.

In addition to the shape of the guide groove 554, the relative positions of the slope portion 504 of the guide groove 554 and the erroneous insertion preventing protrusion 502 are important. That is, when the lever arm 563 is located at the set position, and when the ink cartridge 511 is inserted, as shown in FIG. 25B, the slide lock piece 548 is brought into contact with the erroneous insertion preventing protrusion 502 and takes a locus for preventing the erroneous insertion of the ink cartridge 511.

Therefore, when the ink cartridge 511 is inserted in a proper state where the lever arm 563 is located at the reset position, as shown in FIG. 24, the slide lock piece 548 can reach the engagement concave portion 557, without being brought into contact with the erroneous insertion preventing protrusion 502, and thus the holding state of the cartridge holding unit 530 is ensured.

With this configuration, in the ink cartridge attachment/detachment device 500 of the related art, the erroneous insertion of the ink cartridge 511 due to the positional difference of the lever arm 563 rarely occurs. Further, since a size of a slider holder 537 does not need to be accurately set and a complex attitude keeping structure does not need to be used so as not to cause the inclination of the ink cartridge 511, with only a cam groove 554 having a comparatively simple structure, the erroneous insertion of the ink cartridge 511 can be prevented.

However, in the ink cartridge erroneous insertion preventing unit 501 of the related art, when a user inserts the ink cartridge 511 by a predetermined distance in a state where the insertion of the ink cartridge 511 is not enabled, the ink cartridge 511 are brought into contact with the specific members (502, 536, and 548) of the ink cartridge erroneous insertion preventing unit 501, and the ink cartridge 511 cannot be inserted beyond that. Therefore, the ink cartridge 511 (506) and the specific members (502, 536, and 548) are brought into contact with each other in the recording apparatus, and thus the user cannot visually check why the ink cartridge 511 cannot be inserted beyond that. For this reason, the user tries to insert the ink cartridge 511 with all the strength, and the mechanisms in the recording apparatus may be damaged.

SUMMARY OF THE INVENTION

The invention has been finalized in consideration of the above-described problems, and it is an object of the invention to provide an ink cartridge attachment/detachment device which prevents an insertion action of an ink cartridge by a user in a state where the insertion of the ink cartridge is not enabled, a recording apparatus having such an attachment/detachment device, and a liquid ejection apparatus having such an attachment/detachment device.

According to a first aspect of the invention, an ink cartridge attachment/detachment device provided with an insertion opening into which an ink cartridge is inserted, and adapted to load the ink cartridge into a recording apparatus, the device comprising:

a cartridge holding unit, holding the ink cartridge inserted from the insertion opening in the recording apparatus;

a lever arm, movable from a reset position at which the lever arm is positioned when a loading of an ink cartridge is enabled to a set position at which the lever arm is positioned when the loading of the ink cartridge is completed;

a power transmitting and converting mechanism, converting a rotation of the lever arm into a movement required for loading the ink cartridge held by the cartridge holding unit; and an ink cartridge erroneous insertion action preventing unit, preventing an insertion action of the ink cartridge when the lever arm is not at the reset position.

According to the first aspect of the invention, the ink cartridge attachment/detachment device includes the ink cartridge erroneous insertion action preventing unit. Therefore, when the lever arm is located at the set position at which the lever arm is supposed to be when loading of the ink cartridge is completed or when the lever arm is located at the position other than the reset position at which loading of the ink cartridge is enabled, the insertion action of the ink cartridge by the user can be prevented. That is, the erroneous insertion action itself can be prevented, and thus the mechanisms in the recording apparatus are not damaged by the erroneous insertion action.

According to a second aspect of the invention, in the ink cartridge attachment/detachment device according to the first aspect, the ink cartridge erroneous insertion action preventing unit may include a blocking member, adapted such that the blocking member blocks an approach path of the ink cartridge to the insertion opening from an outside of the recording apparatus when the lever arm is not at the reset position, and that the blocking member is retracted from the approach path to permit the ink cartridge to be inserted when the lever arm is at the reset position.

According to the second aspect of the invention, in addition to the same advantages as those in the first aspect, the ink cartridge erroneous insertion action preventing unit includes the blocking member that blocks the approach path when the lever arm is located at the set position or when the lever arm is located at the position other than the reset position and is retracted from the approach path when the lever arm is located at the reset position. Therefore, since the approach path is blocked by the blocking member when the lever arm is located at the set position or when the lever arm is located at the position other than the reset position, the user cannot insert the ink cartridge into the insertion opening. At this time, since the approach path is blocked by the blocking member, there is little possibility that the user tries to insert the ink cartridge. That is, the user visually checks whether or not the approach path is blocked by the blocking member and judges whether or not to insert the ink cartridge.

The blocking member blocks the insertion opening from the outside of the main body of the recording apparatus. That is, since the blocking member blocks the insertion opening from the outside, not the inside, it is possible for the user to easily perform the visual check.

According to a third aspect, in the ink cartridge attachment/detachment device according to the second aspect, wherein the lever arm may be provided with a lever knob at one end side thereof, and the blocking member may be a protrusion provided at a side of the lever knob of the lever arm.

According to the third aspect of the invention, in addition to the same advantages as those in the second aspect, the blocking member is the protrusion that is formed at one end side of the lever arm. Therefore, the approach path can be blocked by a simple configuration.

According to a fourth aspect of the invention, in the ink cartridge attachment/detachment device according to the third aspect, the protrusion may be provided with a guide face guiding the ink cartridge to the insertion opening when the lever arm is positioned at the reset position.

According to the fourth aspect of the invention, in addition to the same advantages as those in the third aspect, the guide face is provided in the protrusion. Further, when the lever arm is located at the reset position, the guide face guides the ink cartridge to the insertion opening. Therefore, when inserting the ink cartridge, the ink cartridge can be easily inserted into the insertion opening.

According to a fifth aspect of the invention, in the ink cartridge attachment/detachment device according to the third or fourth aspect, the lever arm may rotate in a longitudinal direction of the insertion opening, and the protrusion may extend in a lateral direction (perpendicular to the longitudinal direction) of the insertion opening.

According to the fifth aspect of the invention, in addition to the same advantages as those in the third or fourth aspect, the lever arm rotates in the longitudinal direction of the insertion opening, and the protrusion extends in the lateral direction of the insertion opening. For example, when the lever arm is located at the set position, the protrusion can be provided so as to be located at the center of the insertion opening. Therefore, even though the protrusion is provided comparatively short, the erroneous insertion of the ink cartridge and the erroneous insertion action can be reliably prevented by locating the protrusion at the center of the insertion opening.

According to a sixth aspect of the invention, in the ink cartridge attachment/detachment device according to the fifth aspect, the protrusion may block half or more of the insertion opening in the lateral direction of the insertion opening.

According to the sixth aspect of the invention, in addition to the same advantages as those in the fifth aspect, the protrusion blocks half or more of the insertion opening in the lateral direction of the insertion opening. Therefore, when the lever arm is located at the position other than the reset position at which loading of the ink cartridge is enabled, the insertion action of the ink cartridge, that is, the erroneous insertion action can be reliably prevented. Further, the user can visually understand the erroneous insertion action, and thus the erroneous insertion action can be prevented.

According to a seventh aspect of the invention, in the ink cartridge attachment/detachment device according to the fifth or sixth aspect, when the lever arm is located at the set position, the protrusion may be located at a center of the insertion opening in the longitudinal direction of the insertion opening.

According to the seventh aspect of the invention, in addition to the same advantages as those in the fifth or sixth aspect, when the lever arm is located at the set position, the protrusion is located at the center of the insertion opening in the longitudinal direction of the insertion opening. Therefore, when the lever arm is located at the set position, the insertion action of the ink cartridge, that is, the erroneous insertion action can be reliably prevented. Further, the user can visually understand the erroneous insertion action, and thus the erroneous insertion action can be prevented.

According to an eighth aspect of the invention, in the ink cartridge attachment/detachment device according to any one of the fifth to seventh aspects, a rotation fulcrum of the lever arm may be provided at a position offset the center of the insertion opening in the longitudinal direction of the insertion opening.

According to the eighth aspect of the invention, in addition to the same advantages as those in any one of the fifth to seventh aspects, the rotation fulcrum of the lever arm is provided at the position offset the center of the insertion opening in the longitudinal direction of the insertion opening. Therefore, during the rotation of the lever arm, a moving direction of the protrusion can be inverted in the insertion/discharge direction of the ink cartridge.

For example, when the rotation fulcrum of the lever arm is provided at the center in the longitudinal direction of the insertion opening, the locus of the protrusion is changed from a close state to the insertion opening to a farthest state along the discharge direction at the center opposing the rotation fulcrum when moving from the set position to the reset position. The moving direction is inverted in the insertion/discharge direction, and the locus of the protrusion becomes the close state again. That is, when the lever arm rotates from the set position to the reset position, the protrusion may press the discharged ink cartridge in the insertion direction opposite to the discharge direction. According to this aspect, the rotation fulcrum of the lever arm is provided at the position offset with respect to the center of the insertion opening in the longitudinal direction of the insertion opening. Therefore, the moving direction of the protrusion when the lever arm rotates from the set position to the reset position can be gradually apart from the insertion opening to the discharge direction along the insertion/discharge direction. As a result, there is no case where the protrusion pushes back the ink cartridge in the insertion direction, and thus the ink cartridge can be reliably discharged.

According to a ninth aspect of the invention, in the ink cartridge attachment/detachment device according to any one of the fifth to eighth aspects, before the ink cartridge is held by the cartridge holding unit and before the insertion of the ink cartridge or under the insertion of the ink cartridge, the protrusion of the lever arm may be restricted by a side face of the ink cartridge in an insertion direction of the ink cartridge, such that rotation of the lever arm from the reset position to the set position is restricted.

According to the ninth aspect of the invention, in addition to the same advantages as those in any one of the fifth to eighth aspects, before the ink cartridge is held by the cartridge holding unit and before the insertion of the ink cartridge or under the insertion of the ink cartridge, the protrusion of the lever arm is restricted by the side face of the ink cartridge in the insertion direction of the ink cartridge, such that rotation of the lever arm from the reset position to the set position is restricted. That is, in a state where the insertion of the ink cartridge is not completed, the lever arm cannot rotate from the reset position to the set position. Therefore, an operation for loading the ink cartridge in a state where the ink cartridge is not held by the cartridge holding unit, that is, an erroneous operation by the user can be prevented.

According to a tenth aspect of the invention, in the ink cartridge attachment/detachment device according to any one of the fifth to ninth aspects, when the lever arm is located at a position other than the set position, the protrusion may be brought into contact with a lid member, which openably rotates to cover the insertion opening, so as to obstruct closing of the lid member.

According to the tenth aspect of the invention, in addition to the same advantages as those in any one of the fifth to ninth aspects, when the lever arm is located at the position other than the set position, the protrusion is brought into contact with the lid member, which openably rotates to cover the insertion opening, so as to obstruct closing of the lid member. That is, a state where the lever arm does not rotate to the set position is a state where loading of the ink cartridge is not completed. In this state, the lid member cannot completely close the insertion opening. As a result, abnormality can be notified to the user. For example, a limit switch may be provided in the vicinity of the insertion opening, and, when the lid member is not completely closed, the main body of the recording apparatus may not be operated. In this case, a warning can be given to the user.

According to an eleventh aspect of the invention, in the ink cartridge attachment/detachment device according to any one of the first to tenth aspects, a first engagement portion may be provided in the lever arm, and a second engagement portion may be provided in a base of the attachment/detachment device so as to be engaged with the first engagement portion. Further, when the lever arm is located at the set position or the reset position, the first engagement portion may be engaged with the second engagement portion.

According to the eleventh aspect of the invention, in addition to the same advantages as those in any one of the first to tenth aspects, when the lever arm is located at the set position or the reset position, the first engagement portion is engaged with the second engagement portion. Therefore, when the lever arm is operated, a click feeling can be generated, and the user can easily recognize the set position or the reset position. As a result, it is possible to reduce a possibility that the lever arm stops at an intermediate position between the set position and the reset position.

Further, when the lever arm is located at the set position or the reset position, with the engagement of the first engagement portion and the second engagement portion, it is possible to hold the position of the lever arm such that the lever arm does not rotate as long as the user does not operate the lever arm. That is, the position of the lever arm can be stabilized to the set position or the reset position.

According to a twelfth aspect of the invention, in the ink cartridge attachment/detachment device according to any one of the first to eleventh aspects, a circular rib may be provided in the lever arm or the base of the attachment/detachment device in the vicinity of the rotation fulcrum of the lever arm, with the rotation fulcrum as a center.

According to the twelfth aspect of the invention, in addition to the same advantages as those in any one of the first to eleventh aspects, the circular rib is provided in the lever arm or the base of the attachment/detachment device in the vicinity of the rotation fulcrum of the lever arm, with the rotation fulcrum as a center. Therefore, the circular rib can reduce friction between an arm main body of the lever arm and the base of the attachment/detachment device, and the user can smoothly rotate the lever arm. Further, since friction between the arm main body and the base of the attachment/detachment device is reduced, stains due to dusts caused by friction can be reduced.

According to an thirteenth aspect of the invention, a recording apparatus includes the ink cartridge attachment/detachment device according to any one of the first to twelfth aspects, which loads an ink cartridge into a main body of the recording apparatus by sliding the ink cartridge.

According to the thirteenth aspect of the invention, the recording apparatus includes the attachment/detachment device according to any one of the first to twelfth aspects. Therefore, in the recording apparatus, the same advantages as those in any one of the first to twelfth aspects can be obtained.

According to a fourteenth aspect of the invention, a liquid ejection apparatus includes a liquid cartridge attachment/detachment device which loads a liquid cartridge into a main body of the liquid ejection apparatus by sliding the liquid cartridge, an insertion opening into which the liquid cartridge is inserted, a cartridge holding unit which holds the liquid cartridge upon insertion of the liquid cartridge through the insertion opening by a first predetermined stroke, a power transmitting and converting mechanism that converts rotation of a lever arm into movement of a second predetermined stroke required for loading the liquid cartridge held by the cartridge holding unit, and a liquid cartridge erroneous insertion action preventing unit that prevents an insertion action of the liquid cartridge by a user when the lever arm is located a set position at which the lever arm is supposed to be when loading of the liquid cartridge is completed or when the lever arm is located at a position other than a reset position at which loading of the liquid cartridge is enabled.

DETAILED DESCRIPTION OF THE INVENTION

Figure 1:
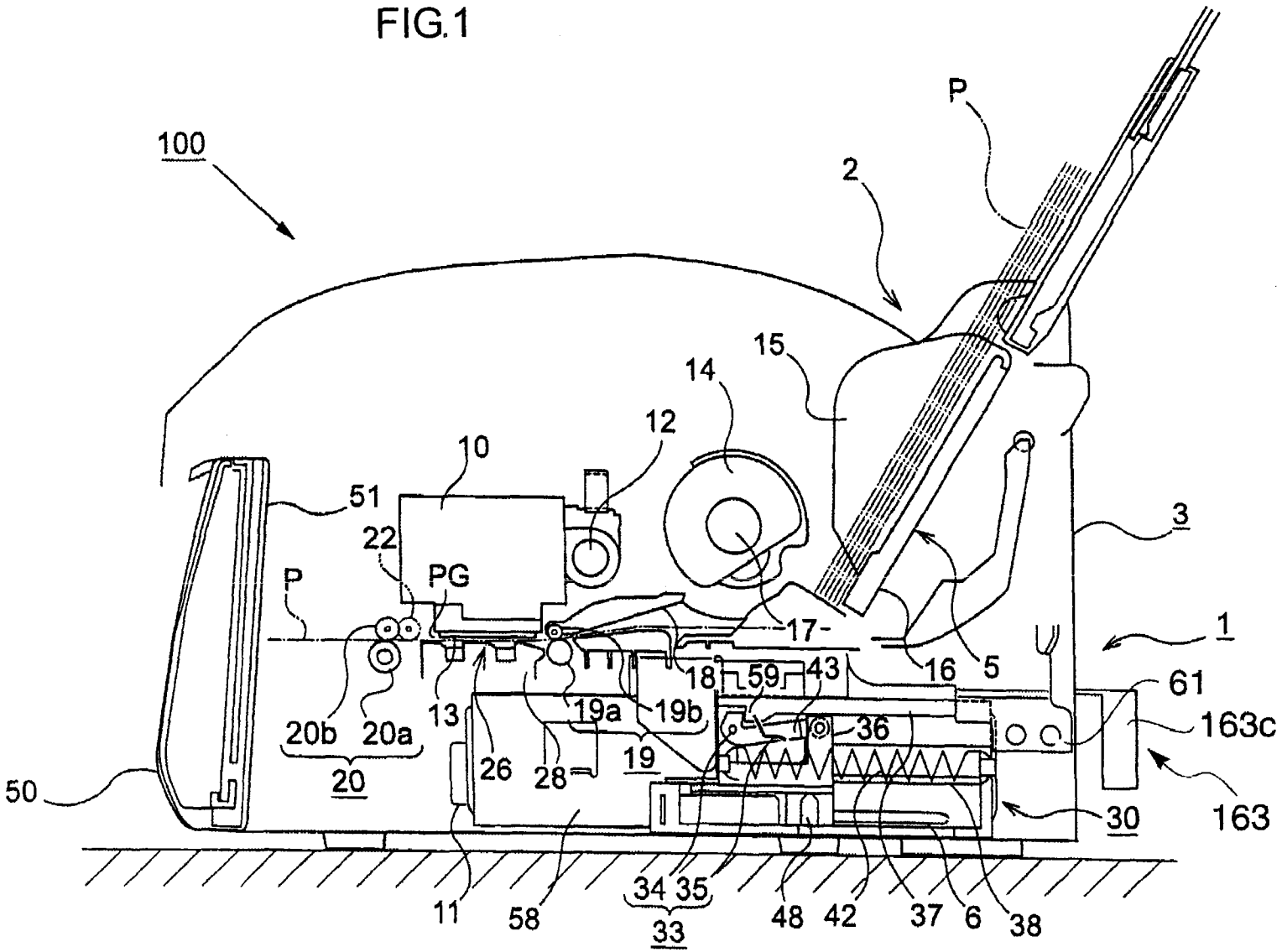
FIG. 1 is a side cross-sectional view showing the outline of an ink jet printer.

A description will now be given for an ink cartridge attachment/detachment device according to the invention and a recording apparatus which is an example of a liquid ejection apparatus having the attachment/detachment device. First, the outline of the overall configuration will be described with reference to the drawings by way of an ink jet printer which is used as the best mode for carrying out the recording apparatus. FIG. 1 is a side cross-sectional view showing the outline of an ink jet printer when an ink cartridge is loaded.

In an ink jet printer 100, a carriage 10 is supported by a carriage guide shaft 12 to reciprocate in a main scanning direction (a direction perpendicular to the paper in FIG. 1). The carriage 10 is the main part of a recording unit that is an example of a liquid ejection unit for recording a recording material P (hereinafter, simply referred to as sheet P) that is an example of a target material for liquid ejection. A recording head 13 is mounted on the carriage 10, and is an example of a liquid ejection head for discharging (ejecting) ink, which is an example of a liquid, to the sheet P. In a space of a main body 3 of the recording apparatus below the carriage 10, a single package type ink cartridge 11, which is an example of a liquid cartridge, is loaded through an ink cartridge attachment/detachment device 1 according to the invention described below.

A platen 28 is provided under and opposite to the recording head 13 to define a gap PG between the head face of the recording head 13 and the sheet P. Recording onto the sheet P or the like is performed by alternately and repetitively performing an operation for conveying the sheet P or the like between the carriage 10 and the platen 28 by a predetermined distance in a sub-scanning direction (a transverse direction in FIG. 1) perpendicular to the main scanning direction, and an operation for ejecting ink to the sheet P or the like from the recording head 13 while the recording head 13 reciprocates one time in the main scanning direction.

The configuration of the ink jet printer 100 will be further described based on a conveyance path of the sheet P. First, a feed tray 5, which is an example of a target material stacking portion for stacking the sheets P, is provided uppermost stream in a conveyance direction. An edge guide 15 is provided in the feed tray 5 to be brought into contact with side end faces of the sheets P and to smoothly guide the sheet P in the sub-scanning direction. As a rotational shaft 17 of a feed roller 14 rotates, a hopper 16 is lifted at a predetermined timing, and pushes up the sheet P on the feed tray S toward the feed roller 14.

A device including the feed tray 5, the feed roller 14, and the hopper 16 is an automatic sheet feeder 2. As the feed roller 14 rotates, a predetermined unit number of sheets P are sequentially picked up beginning from the uppermost sheet P by force exerted of a separation pad which is an example of a separation portion provided near the feed roller 14. The picked-up sheets P are conveyed downstream in the conveyance direction.

A recording material detector (not shown) (hereinafter, referred to simply as 'detection lever'), which is an example of a target material detection unit for detecting that the sheet P passes, is provided downstream the feed roller 14. Further, a conveyance roller 19, which includes a conveyance driving roller 19*a* and a conveyance driven roller 19*b*, is provided downstream the detection lever. Of these elements, the conveyance driven roller 19*b* is supported downstream a roller holder 18 for a conveyance driven roller. The roller holder 18 is provided to rotate on a rotational shaft (not shown) and is rotatably biased by a helical torsion coil spring (not shown), such that the conveyance driven roller 19*b* is constantly pressed into contact with the conveyance driving roller 19*a* to form a nip.

The sheet P, which is sandwiched and conveyed by the conveyance roller 19, is guided to a recording position 26 under the recording head 13, and desired recording is performed for substantially the entire recording face of the sheet P as the carriage 10 and the sheet P are moved in the above-described manner. The gap PG, which is defined between the recording head 13 and the platen 28 provided under and opposite to the recording head 13, is an extremely important element for accurate recording, and is adjusted as needed in accordance with the thickness of the sheet P.

A discharge roller 20, which is an example of a target material discharge unit and includes a discharge driving roller 20*a* and a discharge toothed roller 20*b*, is provided downstream the recording head 13. The sheet P discharged by the discharge roller 20 is placed on a placing face 51 of a discharge stacker 50, which is an example of a target material accepting portion located downstream.

The discharge toothed roller 20*b* has a plurality of teeth along its outer edge, and is rotatably supported by a roller holder (not shown) for a discharge toothed roller. An auxiliary toothed roller 22 is provided upstream the discharge toothed roller 20*b*, and the sheet P is pushed slightly downward by the auxiliary toothed roller 22. The axis of the conveyance driven roller 19*b* is slightly downstream from that of the conveyance driving roller 19*a*. In addition, the axis of the discharge toothed roller 20*b* is slightly upstream from that of the discharge driving roller 20*a*.

With this configuration, between the conveyance roller 19 and the discharge roller 20, the sheet P is slightly bent and convex downwardly, that is, is set in a so-called 'reverse warped' state. Further, the sheet P located opposite to the recording head 13 is pressed against the platen 28 to prevent the lift of the sheet P, and proper recording is performed. Moreover, the auxiliary toothed roller 22 has a plurality of teeth, like the discharge toothed roller 20*b*, and is supported by a roller holder (not shown) for an auxiliary toothed roller.

The ink jet printer 100 according to this example is a printer that uses the single package type ink cartridge 11 with a plurality of color ink cartridges integrally formed, and that horizontally slides the ink cartridge 11 from a lower portion of the feed tray 5 at the back of the main body 3 of the recording apparatus to load the ink cartridge 11 therein.

EMBODIMENT

A description will now be given for an ink cartridge attachment/detachment device according to the invention which is applied to the ink jet printer 100.

Figure 2:
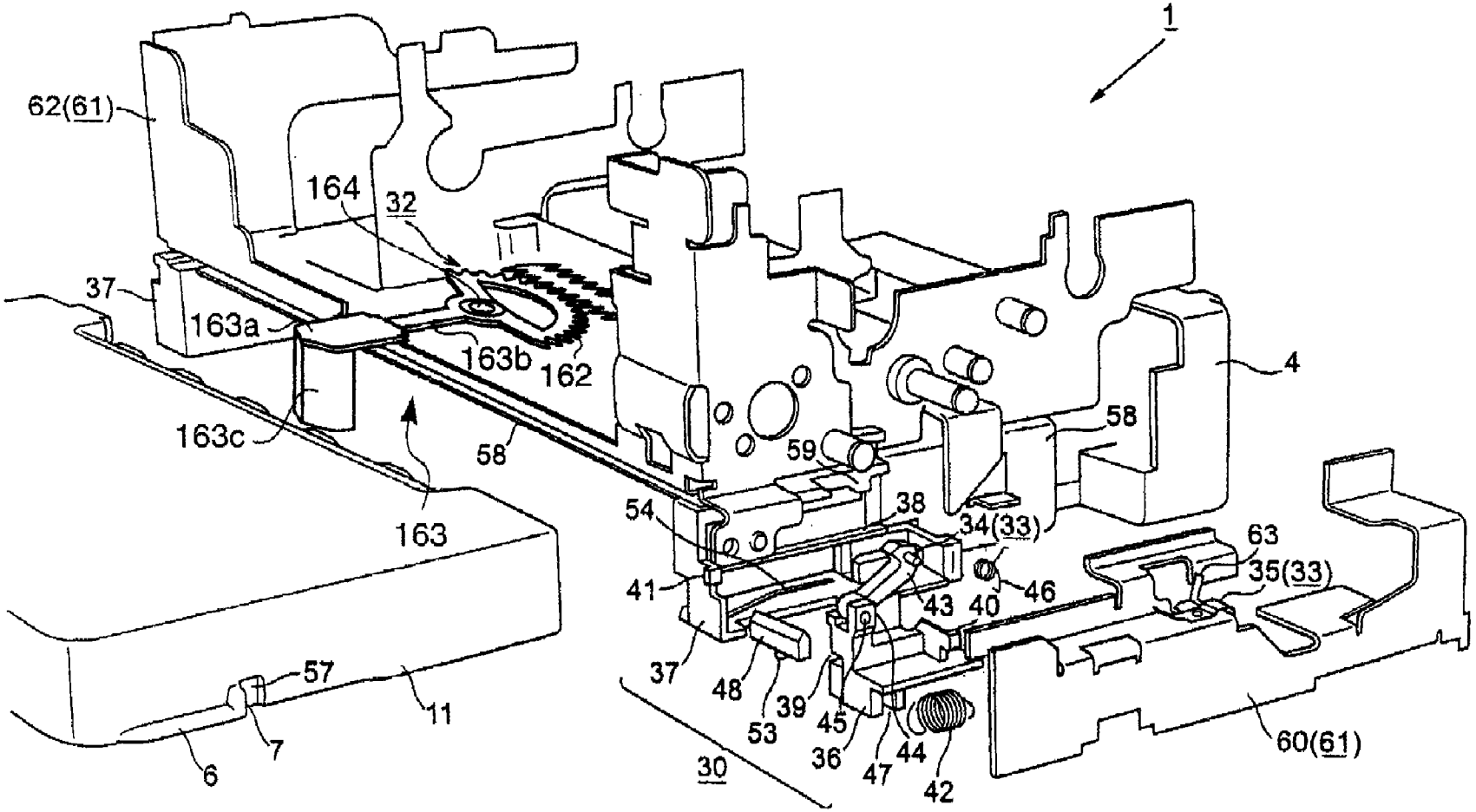
FIG. 2 is an exploded perspective view showing an attachment/detachment device before an ink cartridge is inserted.
Figure 3:
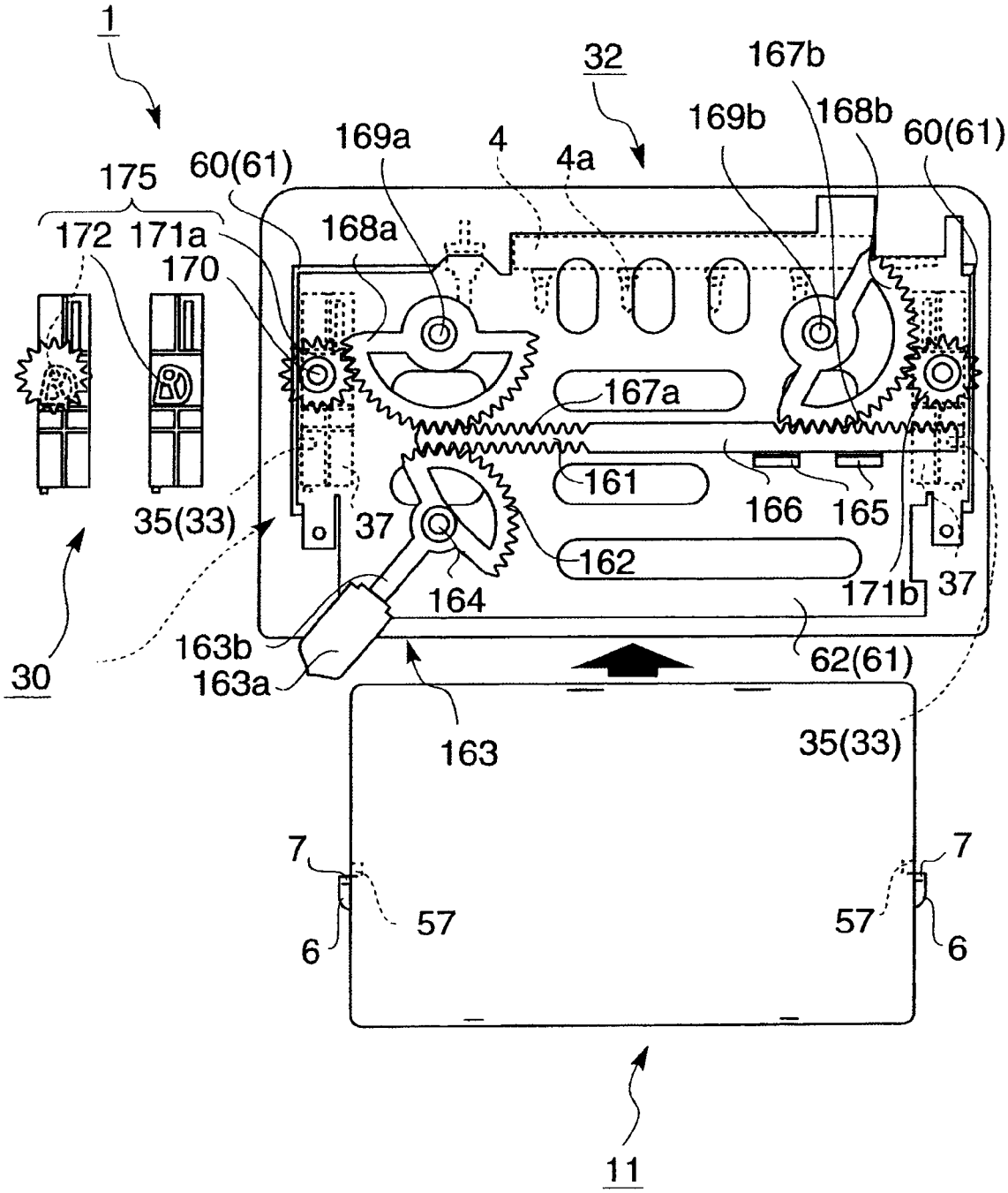
FIG. 3 is a plan view showing the attachment/detachment device before the ink cartridge is inserted.
Figure 4A:
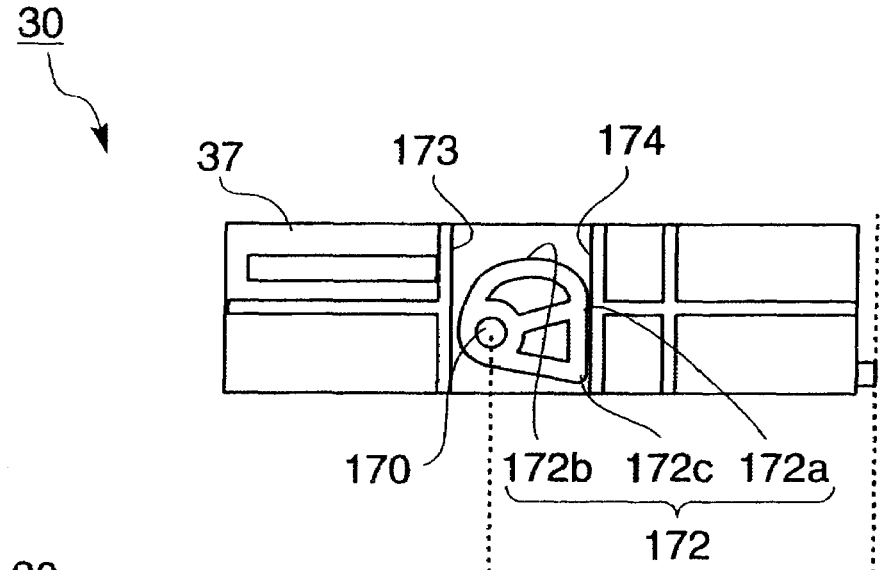
FIGS. 4A to 4C are plan views showing the operation of an eccentric cam portion when the ink cartridge is loaded.
Figure 4B:
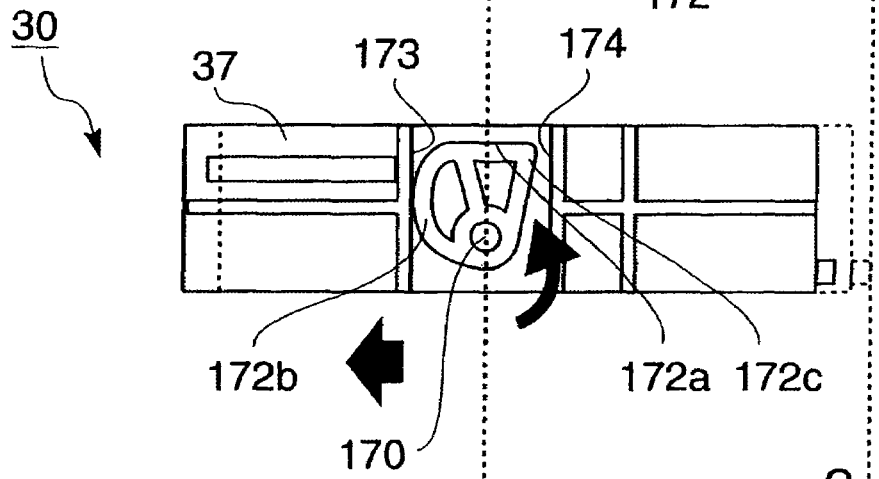
Figure 4C:
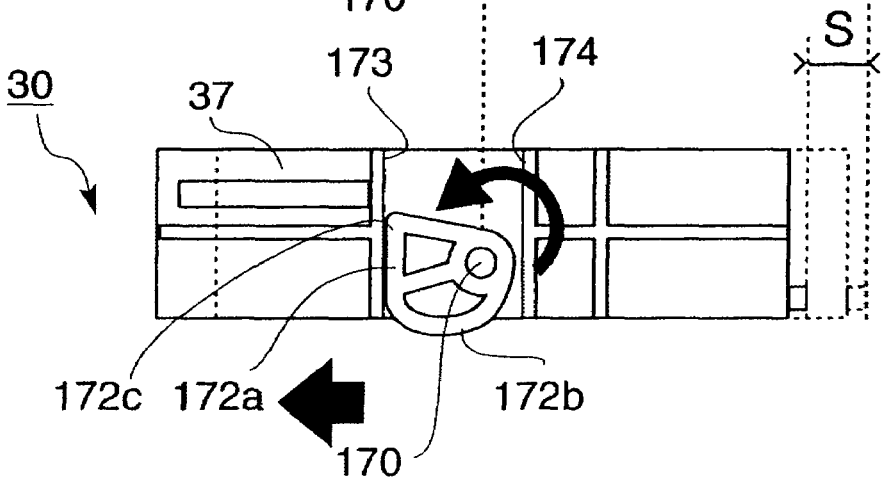
Figure 5:
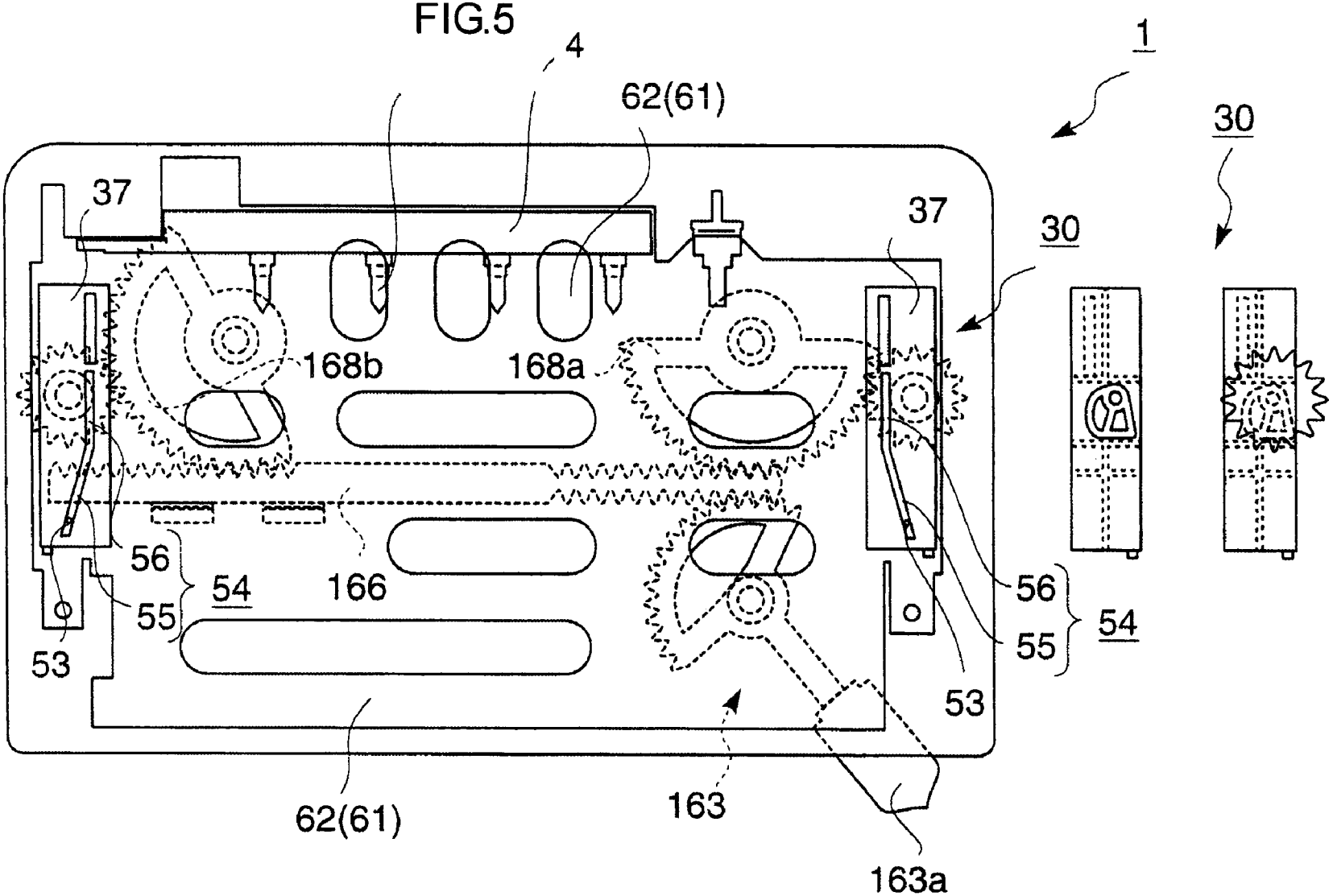
FIG. 5 is a bottom view showing the attachment/detachment device before the ink cartridge is inserted.
Figure 6:
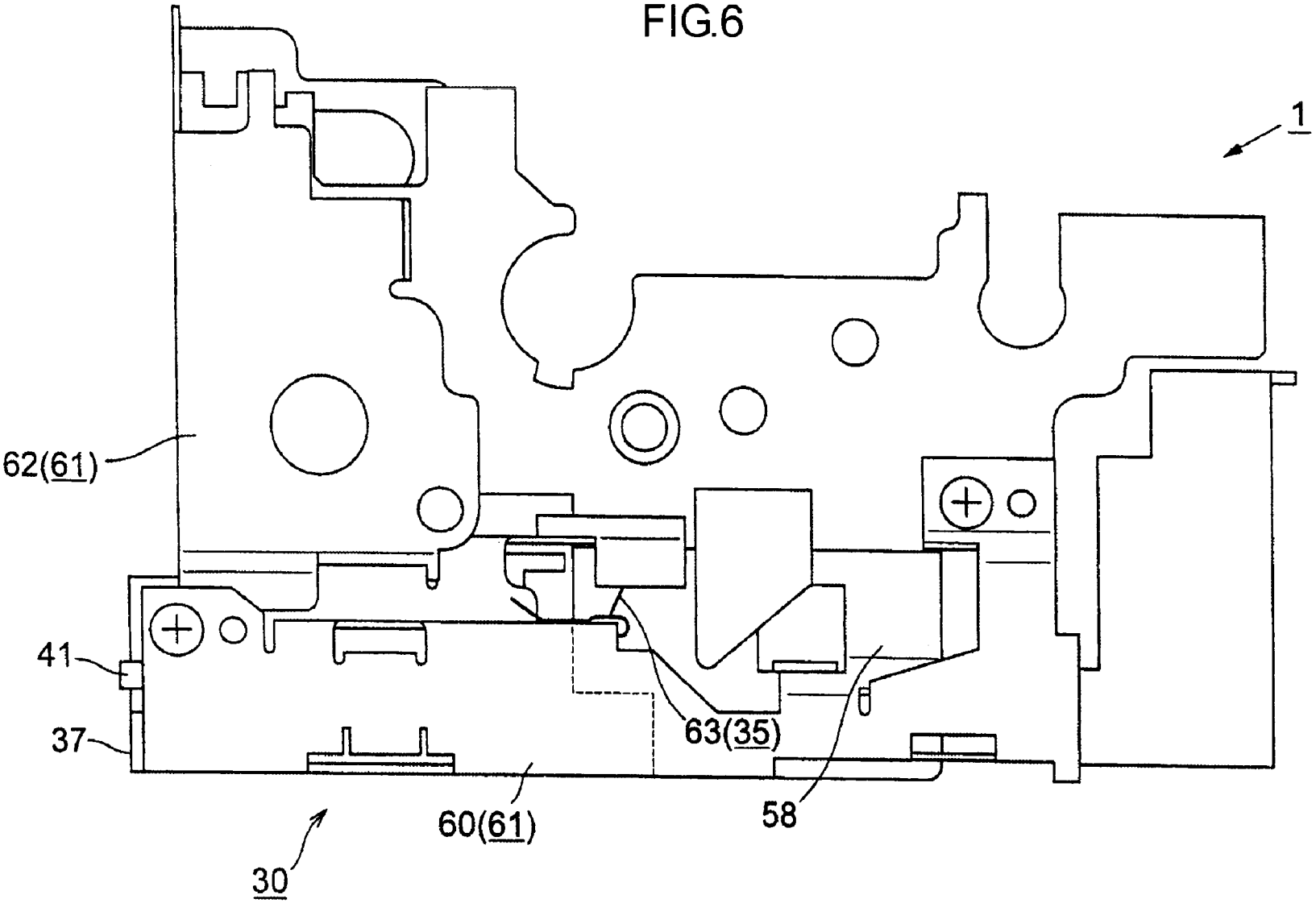
FIG. 6 is a side view showing a cartridge holding unit before the ink cartridge is inserted.
Figure 7:
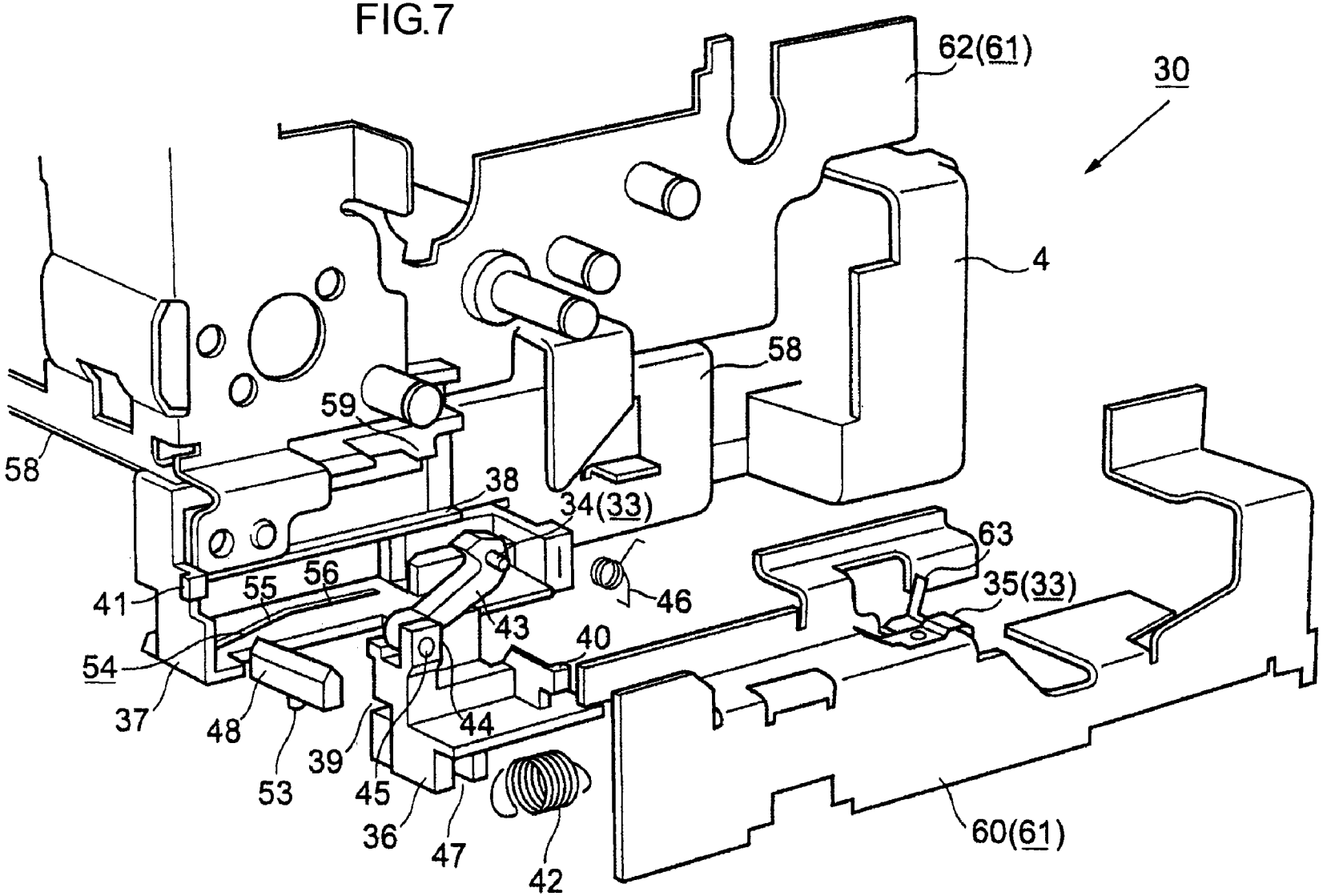
FIG. 7 is an exploded perspective view showing the cartridge holding unit on a magnified scale.

FIG. 2 is an exploded perspective view of the attachment/detachment device in a state before the ink cartridge is inserted. FIG. 3 is a plan view of this state. FIGS. 4A to 4C are plan views showing the operation of an eccentric cam portion 172 when the ink cartridge is loaded. FIG. 5 is a bottom view of the attachment/detachment device before the ink cartridge is inserted. FIG. 6 is a side view of a cartridge holding unit before the ink cartridge is inserted. FIG. 7 is an exploded perspective view of the cartridge holding unit on a magnified scale.

Figure 8A:
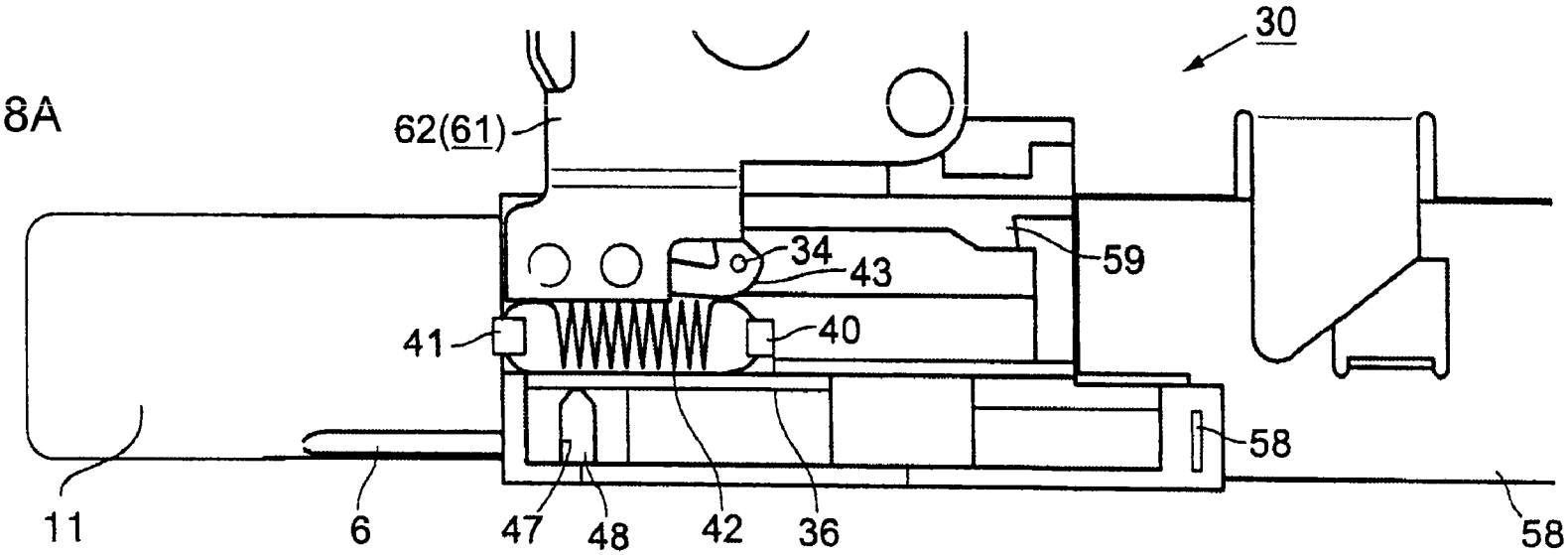
FIGS. 8A and 8B are a side view and a bottom view showing the cartridge holding unit before the ink cartridge is inserted.
Figure 8B:
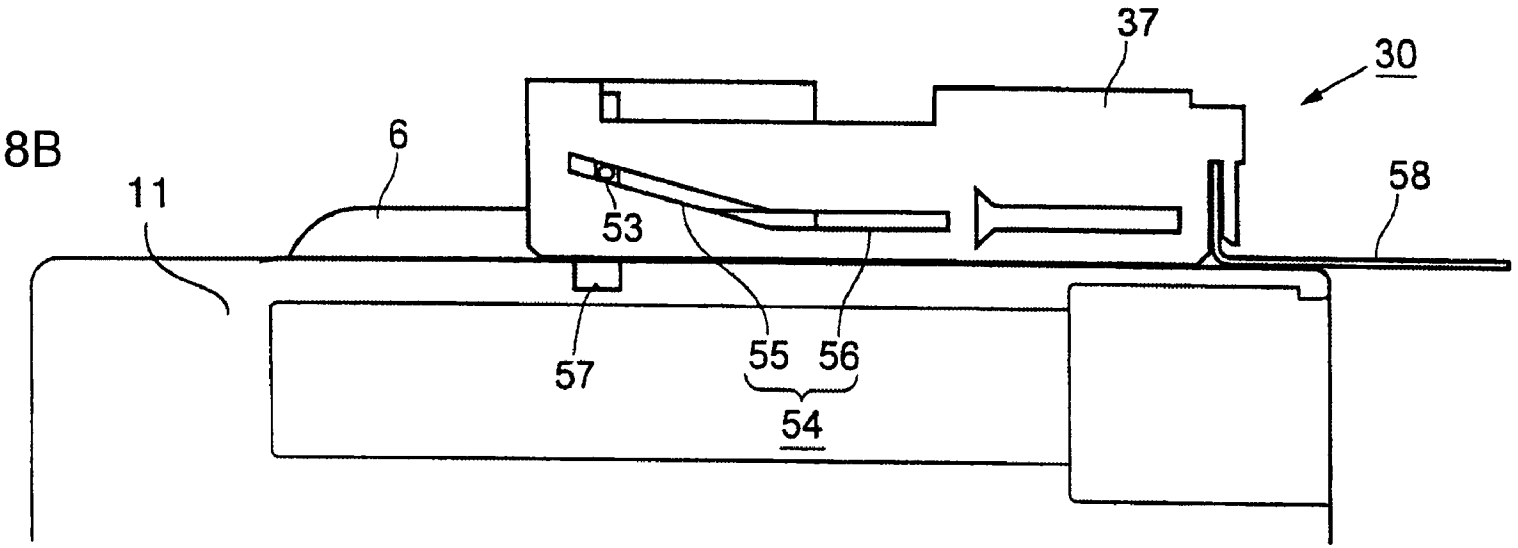
Figure 9:
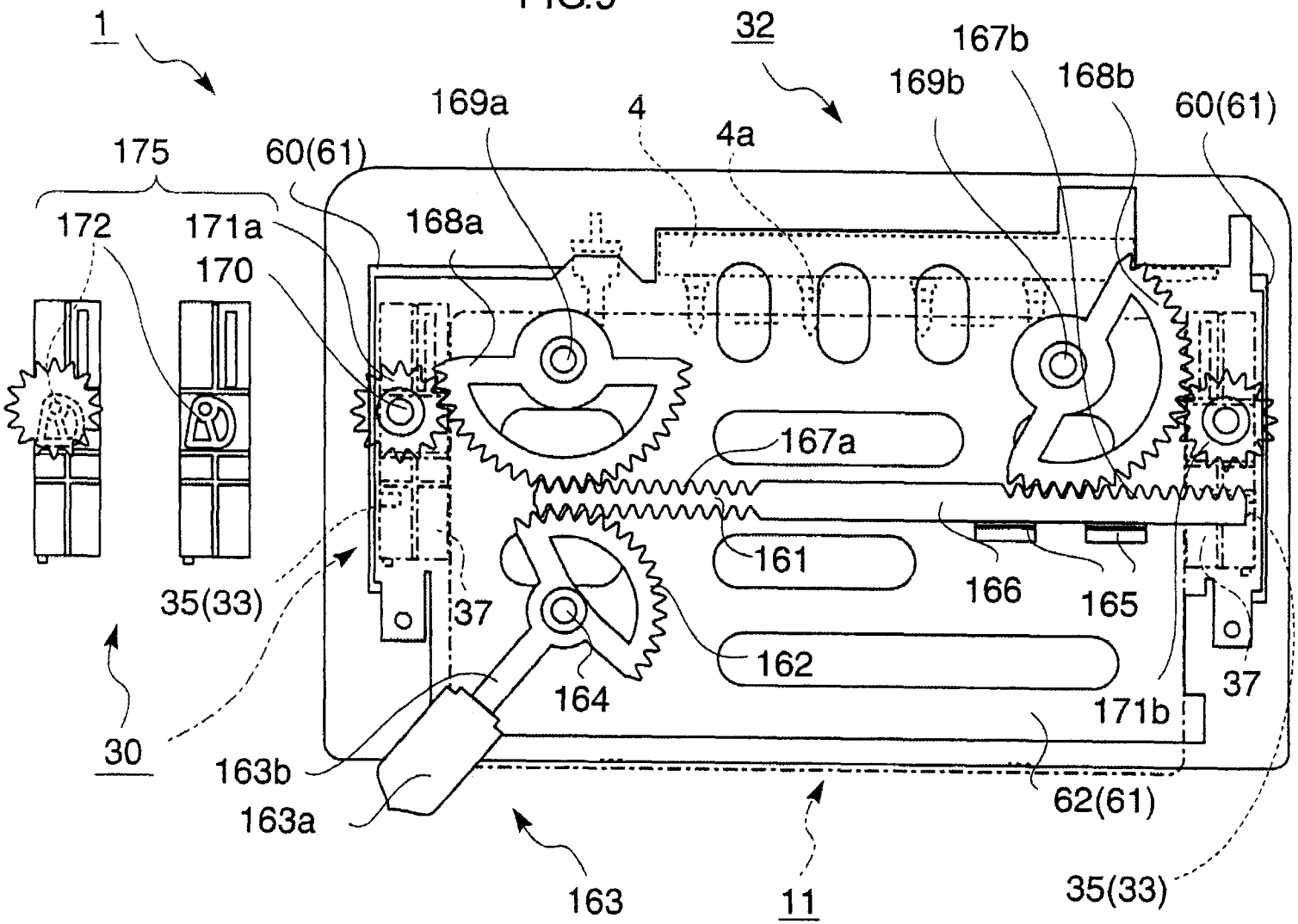
FIG. 9 is a plan view showing the attachment/detachment device when the ink cartridge is completely inserted.
Figure 10A:
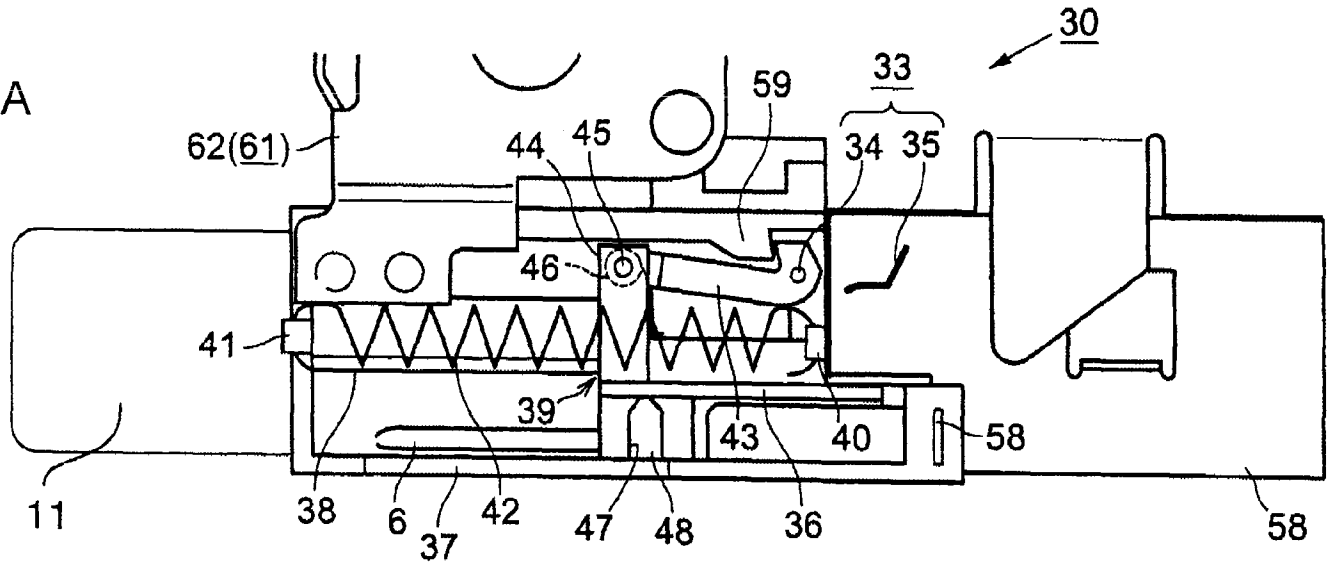
FIGS. 10A and 10B are a side view and a bottom view showing the cartridge holding unit when the ink cartridge is completely inserted.
Figure 10B:
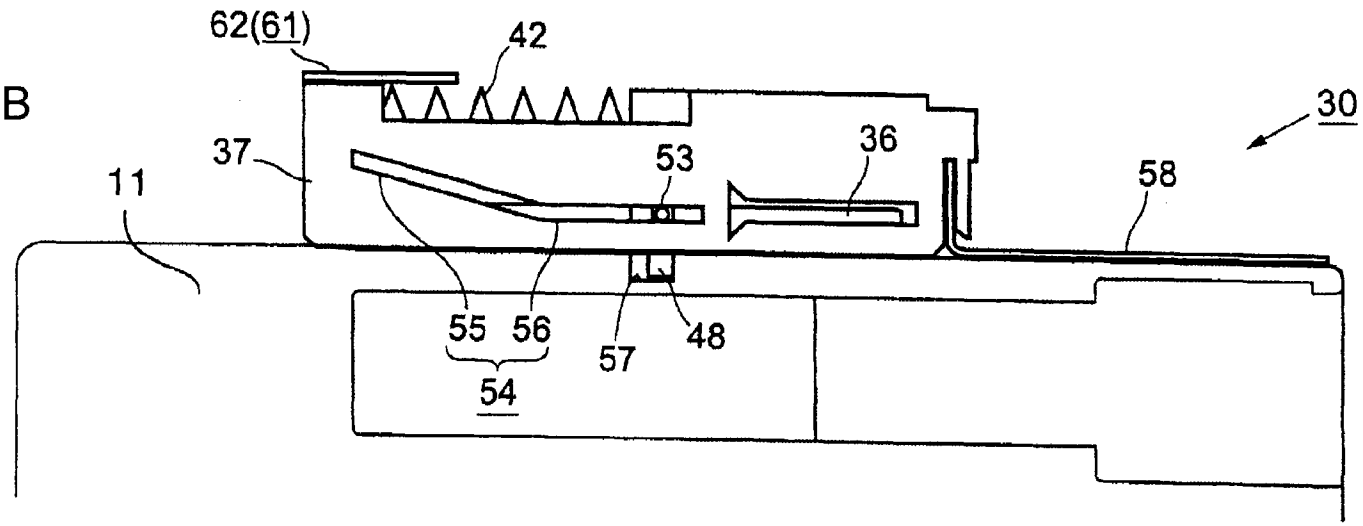

FIGS. 8A and 8B are a side view and a bottom view showing the operation state of the cartridge holding unit at an ink cartridge insertion start position. FIG. 9 is a plan view of the attachment/detachment device when the ink cartridge is completely inserted. FIGS. 10A and 10B are a side view and a bottom view showing the operation state of the cartridge holding unit at an ink cartridge insertion end position.

Figure 11:
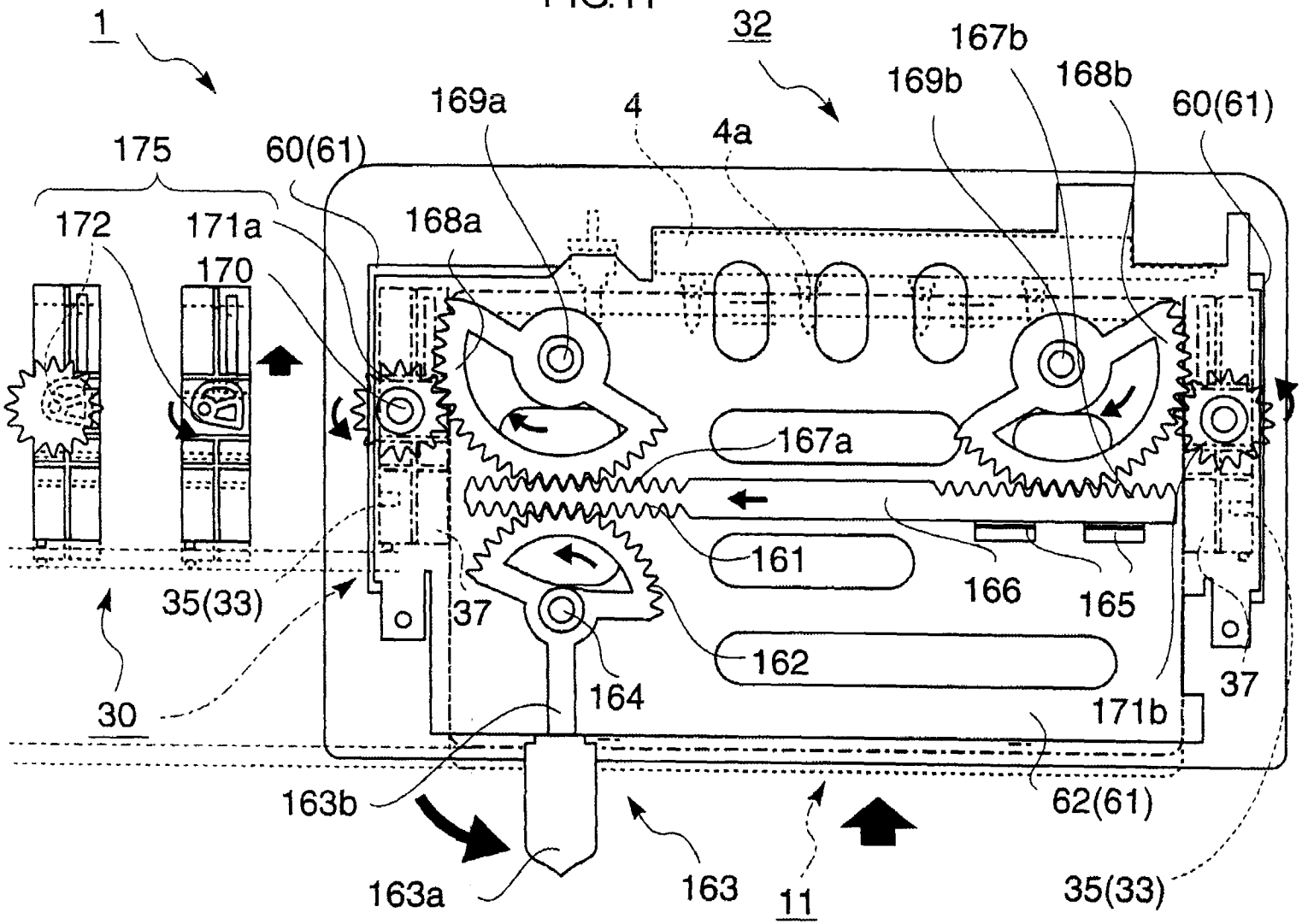
FIG. 11 is a plan view showing the attachment/detachment device where the ink cartridge is being loaded.
Figure 12A:
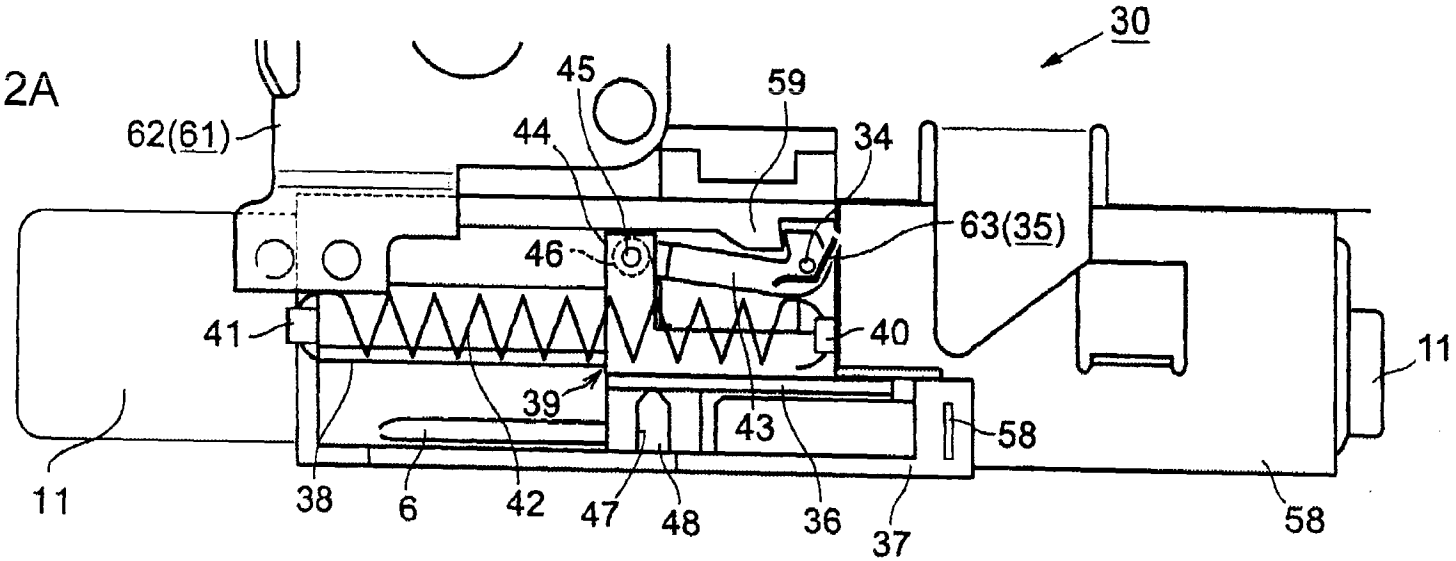
FIGS. 12A and 12B are a side view and a bottom view showing the cartridge holding unit when the ink cartridge is being loaded.
Figure 12B:
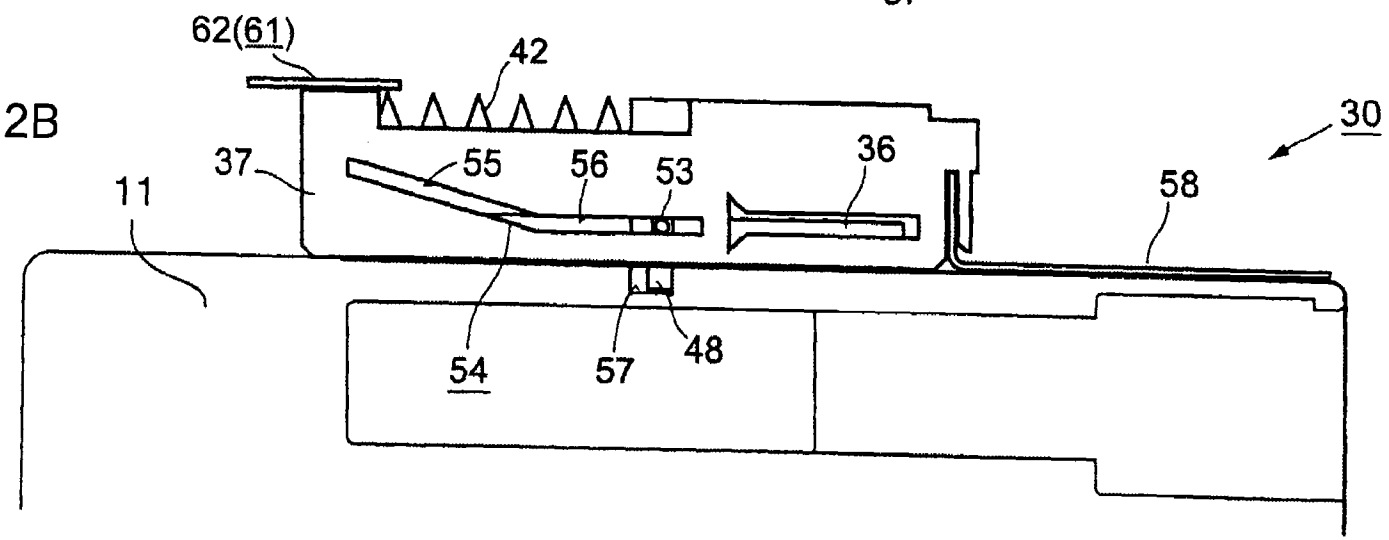
Figure 13:
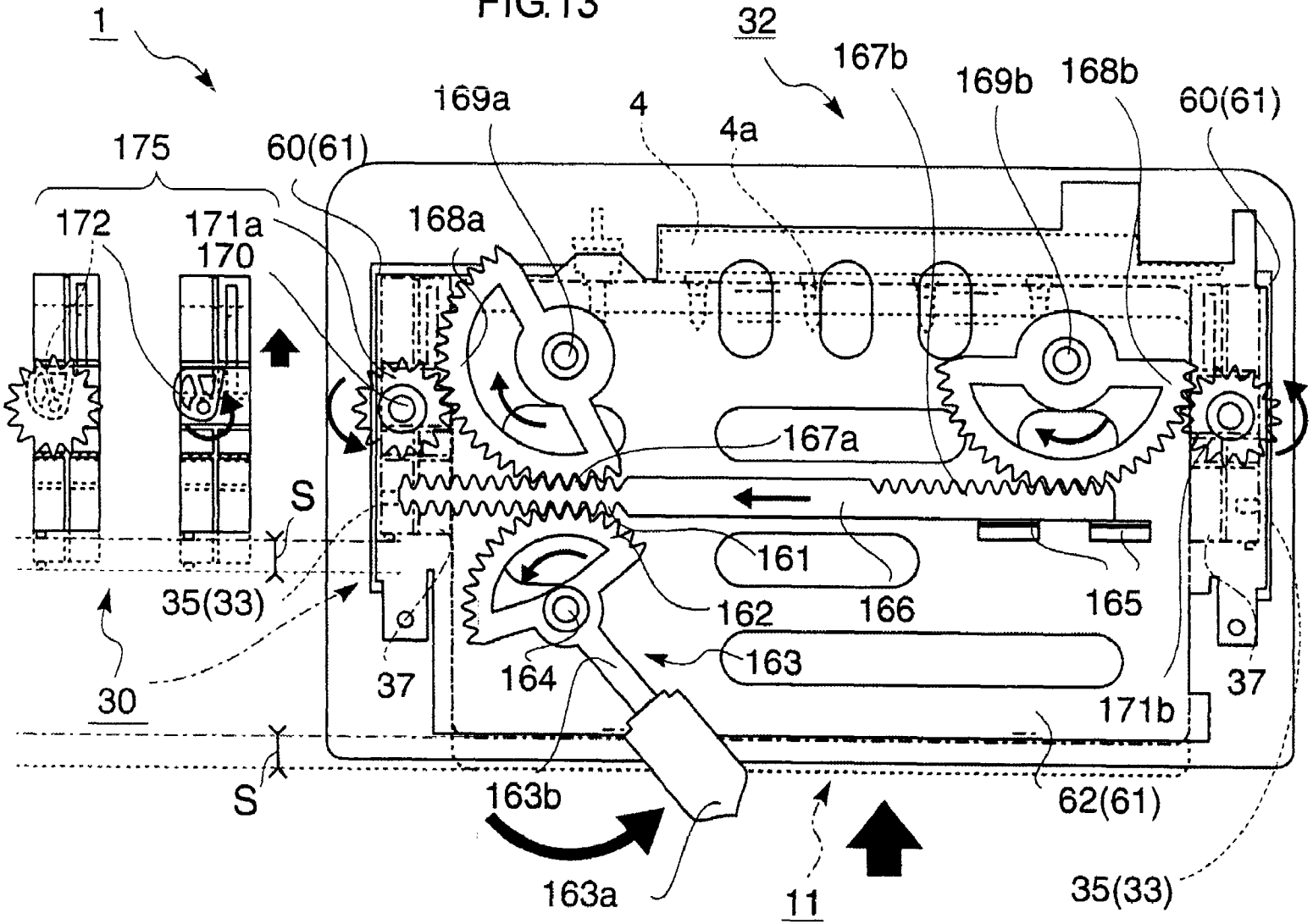
FIG. 13 is a plan view showing the attachment/detachment device when the ink cartridge is completely loaded.
Figure 14A:
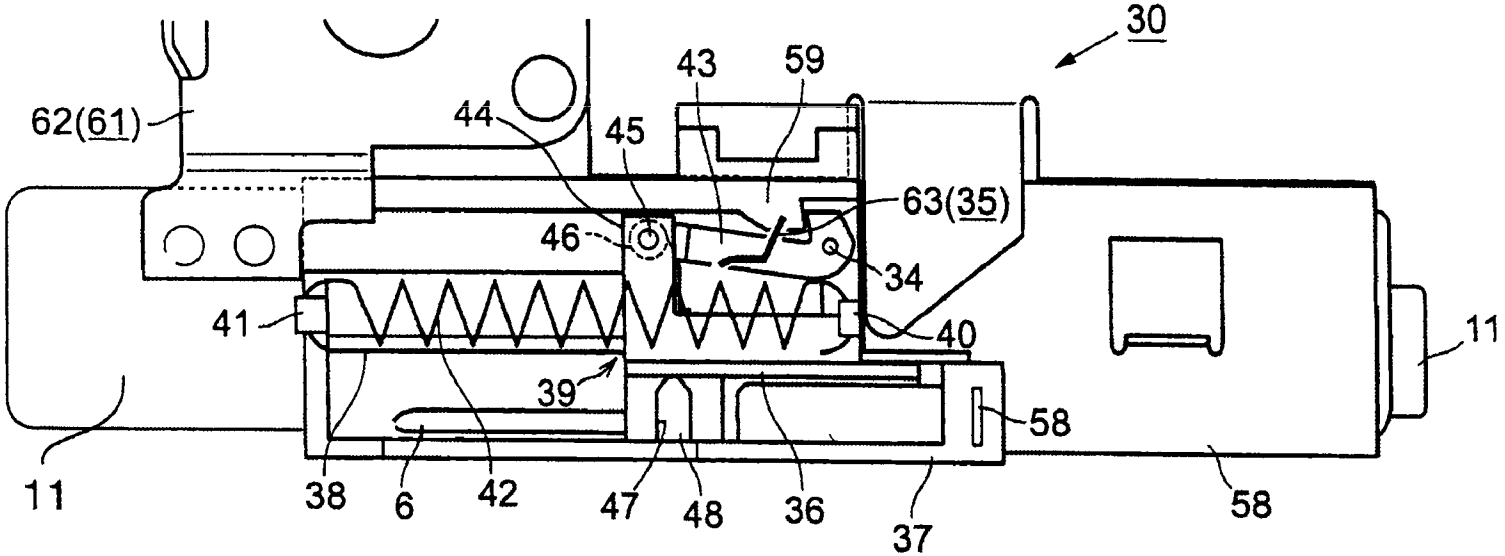
FIGS. 14A and 14B are a side view and a bottom view showing the cartridge holding unit when the ink cartridge is completely loaded.
Figure 14B:
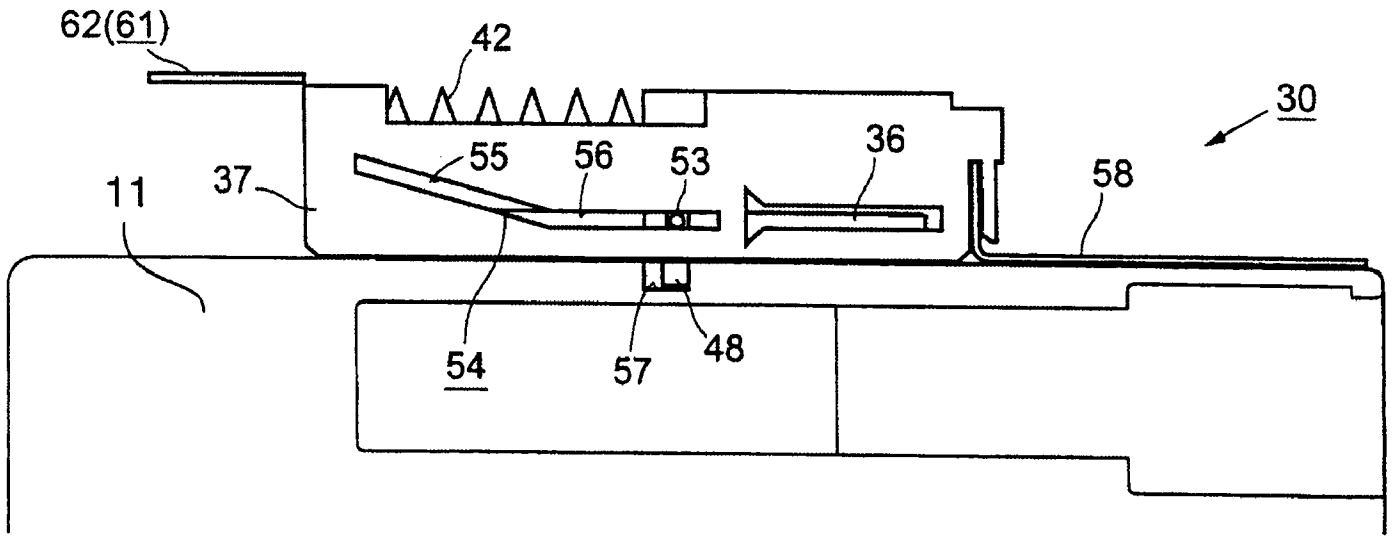
Figure 15:
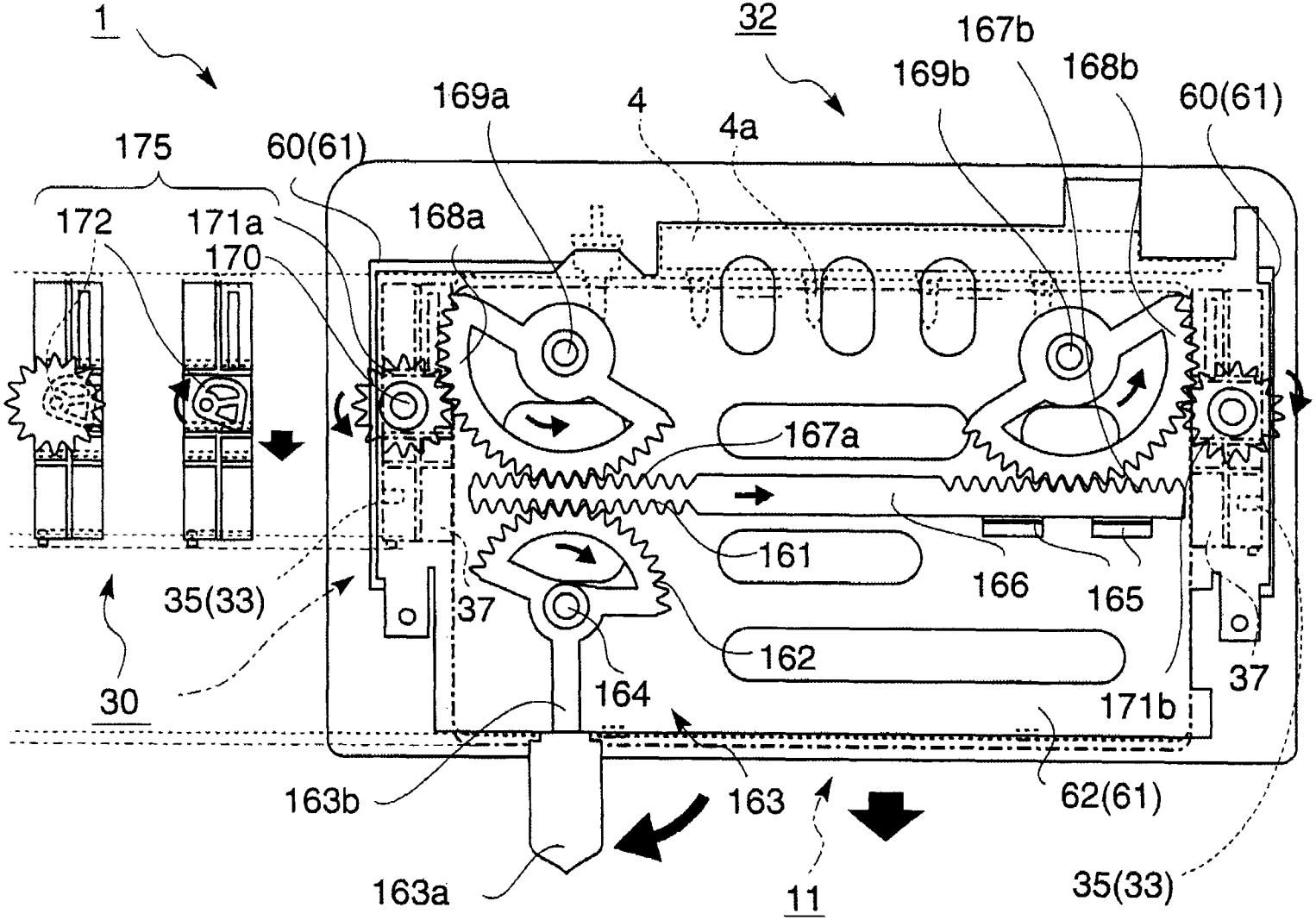
FIG. 15 is a plan view showing the attachment/detachment device when the ink cartridge is extracted.
Figure 16A:
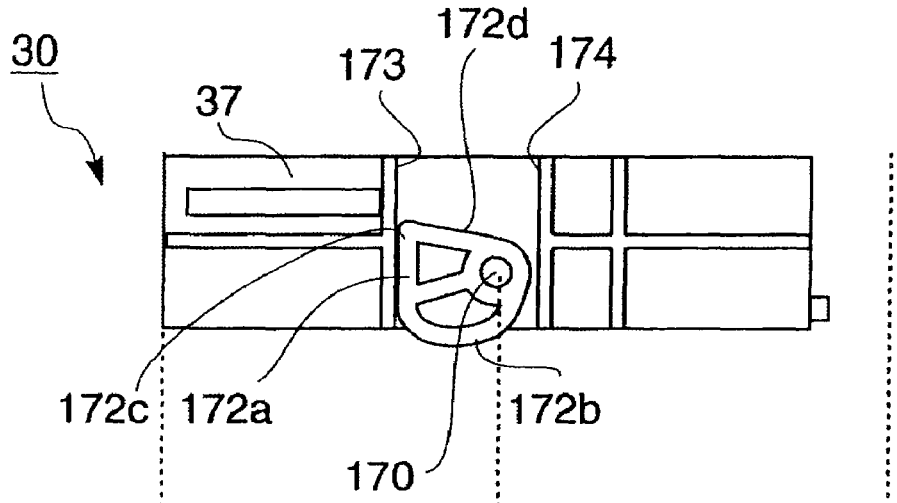
FIGS. 16A to 16C are plan views showing the operation of the eccentric cam portion when the ink cartridge is extracted.
Figure 16B:
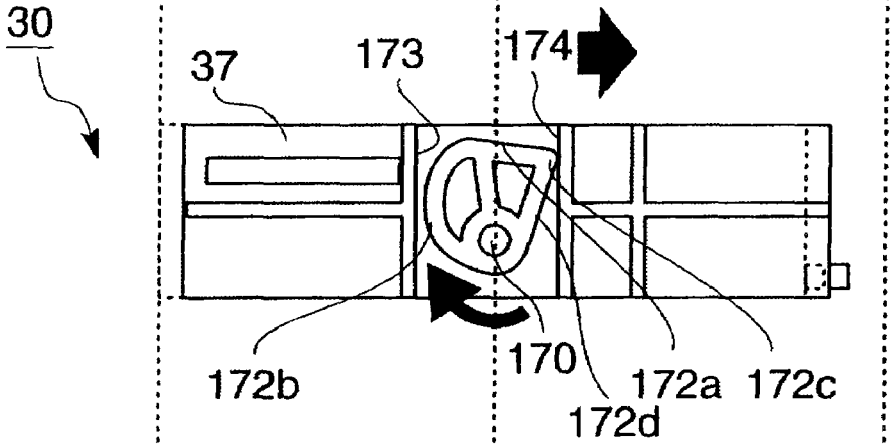
Figure 16C:
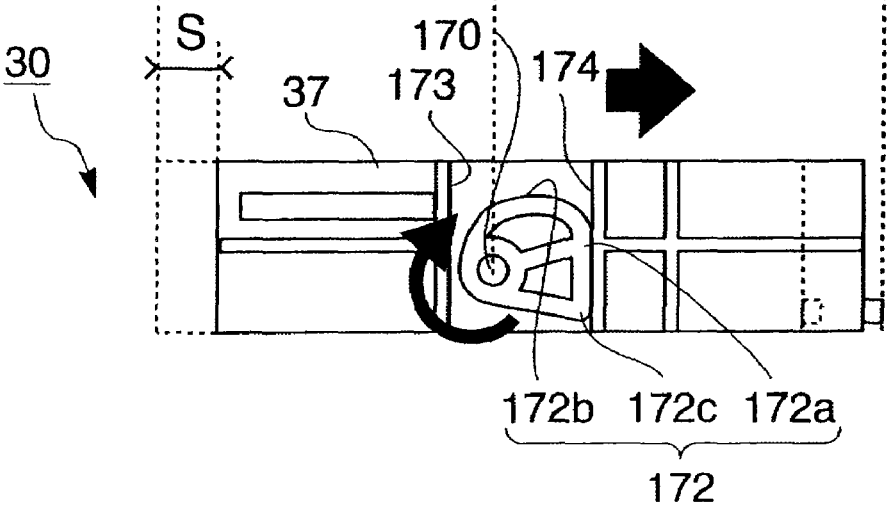
Figure 17A:
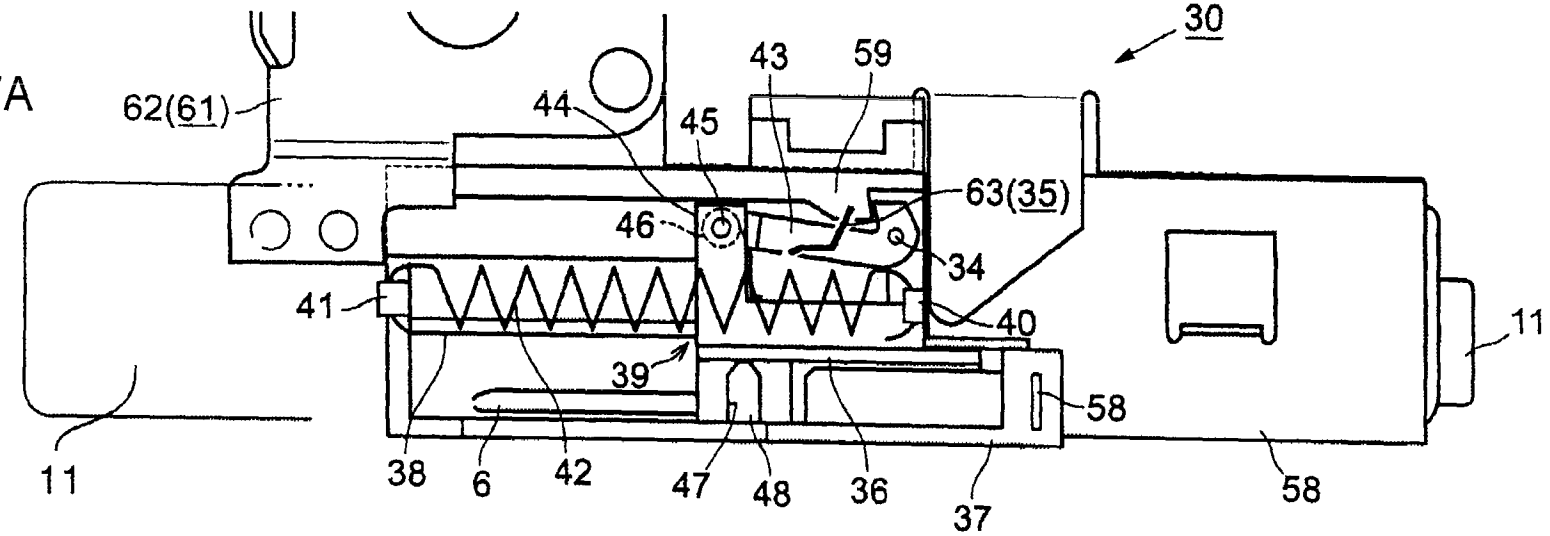
FIGS. 17A and 17B are a side view and a bottom view showing the cartridge holding unit when the ink cartridge is extracted.
Figure 17B:
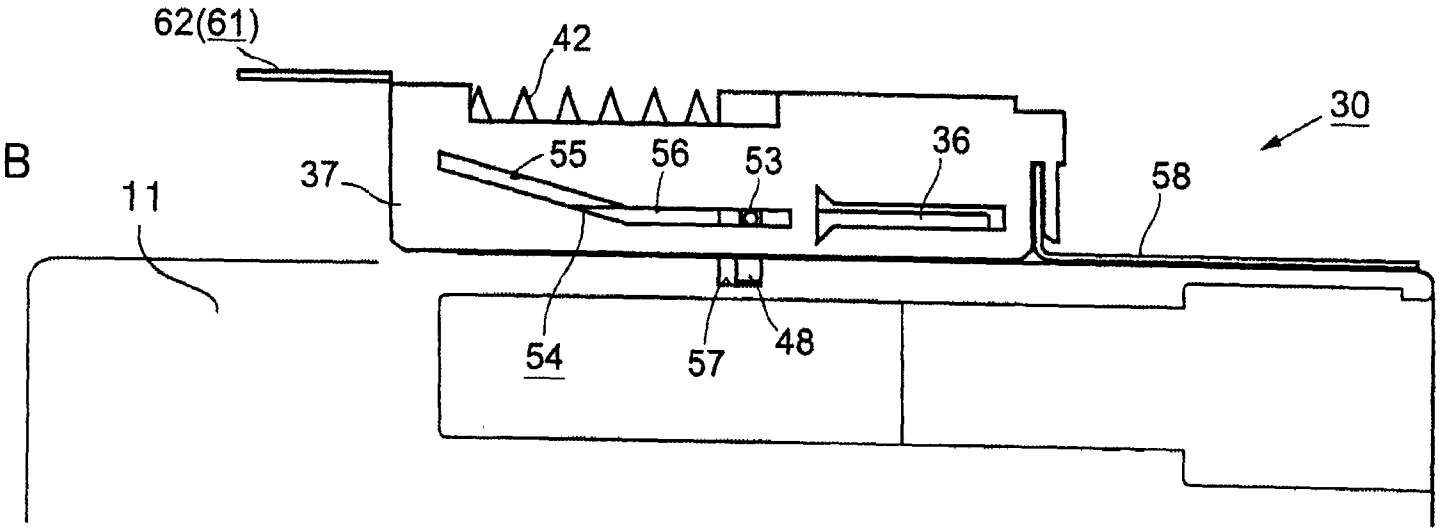

FIG. 11 is a plan view of the attachment/detachment device in a state where the ink cartridge is being loaded. FIGS. 12A and 12B are a side view and a bottom view showing the operation state of the cartridge holding unit in this state. FIG. 13 is a plan view of the attachment/detachment device in a state where the ink cartridge is completely loaded. FIGS. 14A and 14B are a side view and a bottom view of the cartridge holding unit in this state. FIG. 15 is a plan view of the attachment/detachment device in a state of an unlocking moment to extract the ink cartridge. FIGS. 16A to 16C are plan views showing the operation of the eccentric cam portion 172 when the ink cartridge is extracted. FIGS. 17A and 17B are a side view and a bottom view of the cartridge holding unit in this state.

Moreover, the cartridge holding unit and the eccentric cam portion on the left side of FIG. 3, 5, 9, 11, 13 or 15 are shown according to the arrangement states within the recording apparatus.

The ink cartridge attachment/detachment device 1 of the invention has a pair of left and right cartridge holding units 30 that hold the ink cartridge 11 upon insertion of the ink cartridge 11 by a first predetermine stroke, and a power transmitting and converting mechanism 32 that ensures pressing force required for loading the ink cartridge 11 by using rotation of a lever arm 163 and leverage principle, and converts the rotation of the lever arm 163 into movement of a second predetermined stroke S required for loading the ink cartridge 11 held by the cartridge holding units 30. The power transmitting and converting mechanism 32 includes an eccentric cam portion 172, serving as a first cam portion, for moving the cartridge holding unit 30 by the second predetermined stroke S.

Of these elements, each of the cartridge holding units 30 has an unlocking mechanism 33 which is provided as one of feature components of the invention, and which permits extraction of the ink cartridge 11 from the main body 3 of the recording apparatus only by the rotation of the lever arm 163. The unlocking mechanism 33 includes an unlocking pin 34 that is moved together with the ink cartridge 11 as the lever arm 163 rotates, and an elastic unlocking piece 35 that unlocks the ink cartridge 11 by differentiating travel loci of the unlocking pin 34 for the insertion direction and the extraction direction of the ink cartridge 11. The detailed configuration of the unlocking mechanism 33 will be described below, together with other components of the cartridge holding unit 30.

As shown in FIG. 7, the cartridge holding unit 30 includes a lock slider 36 that directly holds the ink cartridge 11, a slider holder 37 that slidably holds the lock slider 36, and the unlocking mechanism 33. The lock slider 36 is a block member that slides by coming into contact with a contact face 7 of a pressing rib 6 in FIG. 2 that protrudes from each of both side faces of the ink cartridge 11.

The lock slider 36 is moved inside the slider holder 37 such that the lock slider 36 slides on and along the inner walls of the upper and lower plates of the slider holder 37, while being guided by a guide rib 38 formed on the inner wall of the slider holder 37. The lock slider 36 is formed with an engagement groove 39 that engages with the guide rib 38 therein. An extraction spring 42, such as a tension coil spring, is suspended between engagement hooks 40 and 41 that are respectively formed on the lock slider 36 and the slider holder 37.

A bearing portion 44 is provided on the lock slider 36 to rotatably support an engagement pawl 43. The bearing portion 44 has a hole that receives a rotational shaft portion 45 disposed at the base end of the engagement pawl 43. Further, attached to the rotational shaft portion 45 is a lock spring 46, such as a helical torsion coil spring, for biasing the engagement pawl 43 toward the upper plate inner wall of the slider holder 37.

The engagement pawl 43 is a member having a hook-shaped pawl formed at a front end thereof. The unlocking pin 34, which is a part of the unlocking mechanism 33, is disposed on the outer face of the pawl in parallel. The lock slider 36 is formed with the guide concave portion 47 extending in a direction perpendicular to a load direction of the ink cartridge 11. And then, a slide lock piece 48 engages with the guide concave portion 47.

The slide lock piece 48 is a flat plate member, the front end of which is cut in a crest shape according to the shape of the guide concave portion 47 with which the slide lock piece 48 engages. The slide lock piece 48 has a guide protrusion 53 on the end face thereof opposing the lower plate of the slider holder 37. The guide protrusion 53 engages with a guide groove 54 formed in the lower plate of the slider holder 37. As the guide protrusion 53 moves in the load direction of the ink cartridge 11 along the shape of the guide groove 54, the slide lock piece 48 also slides in a direction perpendicular to the load direction of the ink cartridge 11.

That is, as shown in FIGS. 5, 8A, 8B, 10A, 10B, 12A, 12B, 14A, 14B, 17A and 17B, the guide groove 54 has a slope portion 55 at a start end side where the ink cartridge 11 is inserted, and a parallel portion 56 parallel to the insertion direction of the ink cartridge 11 at a terminal end side. Further, the slope portion 55 is gradually inclined from outward to inward, and the parallel portion 56 is continuous from an innermost end of the slope portion 55 to extend toward the terminal end in parallel with the load direction, while maintaining this position.

The guide protrusion 53 engaging with the guide groove 54 having this shape takes an outermost position when the guide protrusion 53 is located at the start end where the ink cartridge 11 is inserted. The guide protrusion 53 takes the innermost position when the guide protrusion 53 is located at the terminal end of the slope portion 55, whereby the slide lock piece 48 slides to enter into an engagement concave portion 57 in FIG. 2 that is formed in the side face of the ink cartridge 11. Accordingly, the ink cartridge 11 is held from both sides.

The slider holder 37 is a box-shaped member that has a space for housing the lock slider 36 therein. The slider holder 37 is anchored to a movable frame 58 having a portal cross section as an example, and can slide together with the movable frame 58. A hook-shaped engagement rib 59 is formed on the inner wall of the upper plate of the slider holder 37, and engages with the engagement pawl 43 that is rotatably attached to the lock slider 36. With this structure, the lock slider 36 and the slider holder 37 are combined integrally.

The outer face of the slider holder 37 is open. After the lock slider 36 and the extraction spring 42 are housed, a subframe 60 is used to externally block the open area. Moreover, the subframe 60 is a part of a fixed frame 61, and is attached to a main frame 62 of the fixed frame 61 by screws.

A flow path member 4 is attached to a rear end face of the subframe 60 to be connected to the ink cartridge 11. The flow path member 4 includes needles 4*a* to be inserted into needle insertion openings of the ink cartridge 11, an ink supply path, and a contact point for detecting the residual amount of ink. The elastic unlocking pin 35, which is a part of the unlocking mechanism 33, is attached to the subframe 60. The unlocking piece 35 is a member such as a leaf spring member, and has an elastic tongue piece 63 that extends obliquely upward. The elastic deformation of the elastic tongue piece 63 is used to differentiate the travel loci of the unlocking pin 34 for the load direction and the extraction direction of the ink cartridge 11 (see FIGS. 12A and 17A).

That is, as the elastic tongue piece 63 is bent downward, the unlocking pin 34 can move in the load direction of the ink cartridge 11, while the height of the unlocking pin 34 is maintained. In contrast, when the unlocking pin 34 moves in the extraction direction of the ink cartridge 11, the elastic tongue piece 63 is not bent upward due to an inclination direction of the elastic tongue piece 63. In this case, the unlocking pin 34 moves downward and the travel locus of the unlocking pin 34 changes. Therefore, the engagement pawl 43 integrally formed with the unlocking pin 34 pivots downward, and is disengaged from the engagement rib 59.

Further, a knob 163*a* is provided at one end of the lever arm 163, that is, an arm main body 163*b*. A first pinion 162 having a fan shape, which is an example of a transmission member in the power transmitting and converting mechanism 32, is provided at the other end of the arm main body 163*b* and is attached to rotate about a first rotation pin 164 serving as a fulcrum. A ratio of a distance between the fulcrum and an operation point of the lever arm 163 to a pitch circle radius of the first pinion 162 is used substantially as a leverage ratio. As the distance between the fulcrum and the operation point can be comparatively increased by using the lever arm 163, a large leverage ratio is obtained.

A rack, pinion and cam mechanism can be used as an example of the power transmitting and converting mechanism 32. In this embodiment, the power transmitting and converting mechanism 32 includes the first pinion 162 that rotates together with the lever arm 163, a slide bar 166 that has a first rack 161 meshing with the first pinion 162 and second racks 167 to transmit the movement of the first rack 161 downstream along a transmission path, second pinions 168 that mesh with the second racks 167, a geared cam unit 175 that has gears 171 meshing with the second pinions 168 and an eccentric cam portion 172 to transmit the rotation of the gears 171 downstream along the transmission path, and a first wall portion 173 that is provided close to the cartridge holding unit to be brought into contact with the eccentric cam portion 172 when the ink cartridge 11 moves in a push-in direction.

In this embodiment, the slider bar 166 has the first rack 161 located on a side opposing the first pinion 162, and the second racks 167*a* and 167*b* located on sides opposing the second pinions 168*a* and 168*b*. In addition, the slide bar 78 is guided by the first pinion 162 and the second pinion 168*a* on the first pinion 168*a* side, and is guided by guide ribs 165 of the main frame and the second pinion 168*b* on the second pinion 168*b* side, to thereby reciprocate in a widthwise direction of the main body 3 of the recording apparatus.

Like the first pinion 162, the second pinions 168*a* and 168*b* are formed of fan-shaped gears, and rotate in the same direction about second rotation pins 169*a* and 169*b* serving as fulcrums to transmit power to the gears 171*a* and 171*b*, respectively. The gears 171 (171*a* and 171*b*) rotate about a third rotation pin 170 serving as a fulcrum together with the eccentric cam portion 172 integrally formed with the gears 171. The eccentric cam portion 172 is brought into contact with the first wall portion 173 and the second wall 174 provided in the slider holder 37 of the cartridge holding unit 30 to thereby move the slider holder 37.

A description will now be given for the operation states of the ink cartridge attachment/detachment device 1 having the above-described configuration.

(1) Before Insertion (see FIGS. 2, 3, 5 to 7)

Before the ink cartridge 11 is inserted into the main body 3 of the recording apparatus, as shown in FIG. 3, the lever arm 163 is located at a leftmost position. In this state, the lock sliders 36 are located closest to the start end, and the engagement pawls 43 are in contact with the inner walls of the upper plates of the slider holders 37. As shown in FIG. 5, the guide protrusions 53 are located at the start end positions, which are the outermost positions in the slope portions 55 of the guide grooves 54. Therefore, the slide lock pieces 48 are housed in the guide concave portions 47, such that the insertion of the ink cartridge 11 is permitted.

(2) Start Insertion (see FIGS. 8A and 8B)

When the ink cartridge 11 is manually inserted from the opening in the rear face of the main body 3 of the recording apparatus, the contact faces 7 at the front ends of the pressing ribs 6, which are formed on both side faces of the ink cartridge 11, are brought into contact with the end faces of parts where the guide concave portions 47 are formed, and gradually push the lock sliders 36 forward against biasing force of the extraction springs 42. Accordingly, the guide protrusions 53 move forward in the main body 3 along the slop portions 55 and the parallel portions 56 of the guide grooves 54. As the guide protrusions 53 move forward, the slide lock pieces 48 gradually move inwardly and then protrude.

(3) Completion of Insertion (see FIGS. 9, 10A and 10B)

When the ink cartridge 11 is fully pushed in, that is, a first predetermined stroke, upon generation of clicking sound, the engagement pawls 43 move over the rear faces of the engagement ribs 59 and engage with the engagement ribs 59. In this state, the lock sliders 36 are combined integrally with the slider holders 37, and the guide protrusions 53 reach the terminal ends of the parallel portions 56 of the guide grooves 54. The slide lock pieces 48 completely protrude inwardly, and enter into the engagement concave portions 57 that are formed in both side faces of the ink cartridge 11. In this manner, the ink cartridge 11 is locked and held by the lock sliders 36.

(4) Loading (see FIGS. 4A to 4C, 11, and 12A and 12B)

As shown in FIG. 11, when the lever arm 163 gradually pivots to the right by using the knob 163*a* of the lever arm 163, the first pinion 162 rotates, and rotation force is transmitted to the first rack 161 to move the slider bar 166 to the right. Then, the force is transmitted from the second racks 167 to the gears 171 through the second pinions 168, such that the gears 171 rotate in a counterclockwise direction in FIG. 11. Accordingly, the eccentric cam portion 172 integrally formed with the gears 171 rotates in a counterclockwise direction. As shown in FIGS. 4A to 4C, the eccentric cam portion 172 gradually rotates from the state shown in FIG. 4A in the counterclockwise direction. Then, as shown in FIG. 4B, the cam arc portion 172*b* is pressed into contact with the first wall portion 173 to move the slider holders 37. If the slider holders 37 move, the ink cartridge 11, the movable frame, and the slider holders 37 integrally move toward the rear by the cartridge holding units 30. At this time, when the gears 171 rotate at a constant speed, the cam arc portion 172*b* of the eccentric cam portion 172 is provided to press the first wall portion 173 at constant speed and force. That is, while the eccentric cam portion 172 rotates by 180°, the slider holders 37 move at an almost constant speed.

Moreover, in this state, as shown in FIGS. 12A and 12B, the unlocking pins 34 are located in front of the elastic tongue pieces 63 of the elastic unlocking pieces 35, and move forward along the upper travel locus. Further, the slider lock pieces 48 currently protrude, and enter into the engagement concave portions 57. Accordingly, the ink cartridge 11 is locked and held by the lock sliders 36.

(5) Completion of Loading (see FIGS. 4A to 4C, 13, and 14A and 14B)

When the lever arm 163 pivots to the rightmost position as shown in FIG. 13, the ink cartridge 11 enters more into the rear, and the needles 4*a* formed on the flow path member 4 are inserted into the needle insertion openings of the ink cartridge 11. Specifically, when the eccentric cam portion 172 pivots from the state shown in FIG. 4B in the counterclockwise direction, and a part where the leverage length of the cam at the boundary between the cam arc portion 172*b* and the cam chord portion 172*a* immediately before the state of FIG. 14C becomes maximum is brought into contact with the first wall portion 173, the cartridge holding unit is located at the maximum push-in position. Then, as shown in FIG. 4C, the cam chord portion 172*a* rotates to be brought into face contact with the first wall portion 173. At this time, the cartridge holding unit is pushed back from the maximum push-in position by about 0.5 mm. Therefore, when the cam chord portion 172*a* rotates at that position, the needles 4*a* are sufficiently inserted into the needle insertion openings of the ink cartridge 11. As a result, loading of the ink cartridge 11 is completed.

Moreover, in this state, as shown in FIGS. 14A and 14B, the unlocking pins 34 pass over the elastic tongue pieces 63 and are located behind the elastic tongue pieces 63. Further, the slide lock pieces 48 protrude, and the ink cartridge 11 is held by the lock sliders 36.

(6) Removing (see FIGS. 15, 16A to 16C, and 17A and 17B)

When the lever arm 163 pivots from the rightmost position to the left as shown in FIG. 15, the eccentric cam portion 172 rotates in a clockwise direction as shown in FIGS. 16A to 16C, the angular portion 172*c* of the eccentric cam portion 172 is pressed into contact with the second wall portion 174 to move the slider holders 37 in a direction opposite to the load direction. Then, as shown in FIGS. 17A and 17B, the unlocking pins 34 move downward along the slopes of the elastic tongue pieces 63, pass under the elastic tongue pieces 63 along the lower travel locus, and reach in front of the elastic tongue pieces 63. At this time, the engagement pawls 43, which are integrally formed with the unlocking pins 34, also rotate downward against the biasing force of the lock springs 46, and are disengaged from the engagement ribs 59. Then, when the lever arm 163 moves to the leftmost position shown in FIG. 3, the ink cartridge 11 is ejected by a distance of 22 mm or more from the rear end face of the main body 3 of the recording apparatus by biasing force of the extraction spring 42. Therefore, the ink cartridge 11 is removed.

At this time, even when the lever arm 163 rotates at a uniform speed, the speed of the slider holder 37 to be moved by the rotation of the eccentric cam portion 172 is differentiated for the load and extraction of the ink cartridge 11. That is, the speed is constant when the ink cartridge 11 is loaded, while the speed is not constant when the ink cartridge 11 is extracted. A description will now be given for the operation when the ink cartridge 11 is extracted.

First, when the eccentric cam portion 172 rotates in the clockwise direction from the position shown in FIG. 16A, the slider holder 37 does not move until the angular portion 172*c* is brought into contact with the second wall portion 174. Subsequently, as shown in FIG. 16B, the speed v when the angular portion 172*c* is brought into contact with the second wall portion 174 is represented by the following expression.

$v = A\,\omega \cos \omega t$ (where A is an integer and ω is an angular frequency)

That is, when the eccentric cam portion 172 rotates from the position shown in FIG. 16B to the position shown in FIG. 16C, the slider holder 37 moves at a speed orthographically projected on an x axis of a uniform circular movement because only the angular portion 172*c* is brought into contact with the second wall portion 174. Accordingly, at a position of the eccentric cam portion 172 shown in FIG. 16B, the speed of the slider holder 37 is Max. Then, as the eccentric cam portion 172 rotates to a position shown in FIG. 16C, the speed of the slider holder 37 is gradually decreased and then halted.

That is, when the speed of the slider holder 37 is Max, and the needles 4*a* are pulled out from the ink cartridge 11, the time of the stuck state of the needles 4*a* halfway can be shortened. As a result, when the ink cartridge 11 is extracted, ink leakage due to the stuck state of the needles 4*a* halfway can be reduced.

Moreover, in this embodiment, a line portion 172*d*, which connects the angular portion 172*c* and the rotation fulcrum, is not brought into contact with the first wall portion 173 and the second wall portion 174. However, a swelled portion of a small arc shape may be brought into contact with the second wall portion 174. With the line portion 172*d* of a small arc shape, a speed and timing for pulling the needles 4*a* out from the ink cartridge 11 can be changed.

Figure 18:
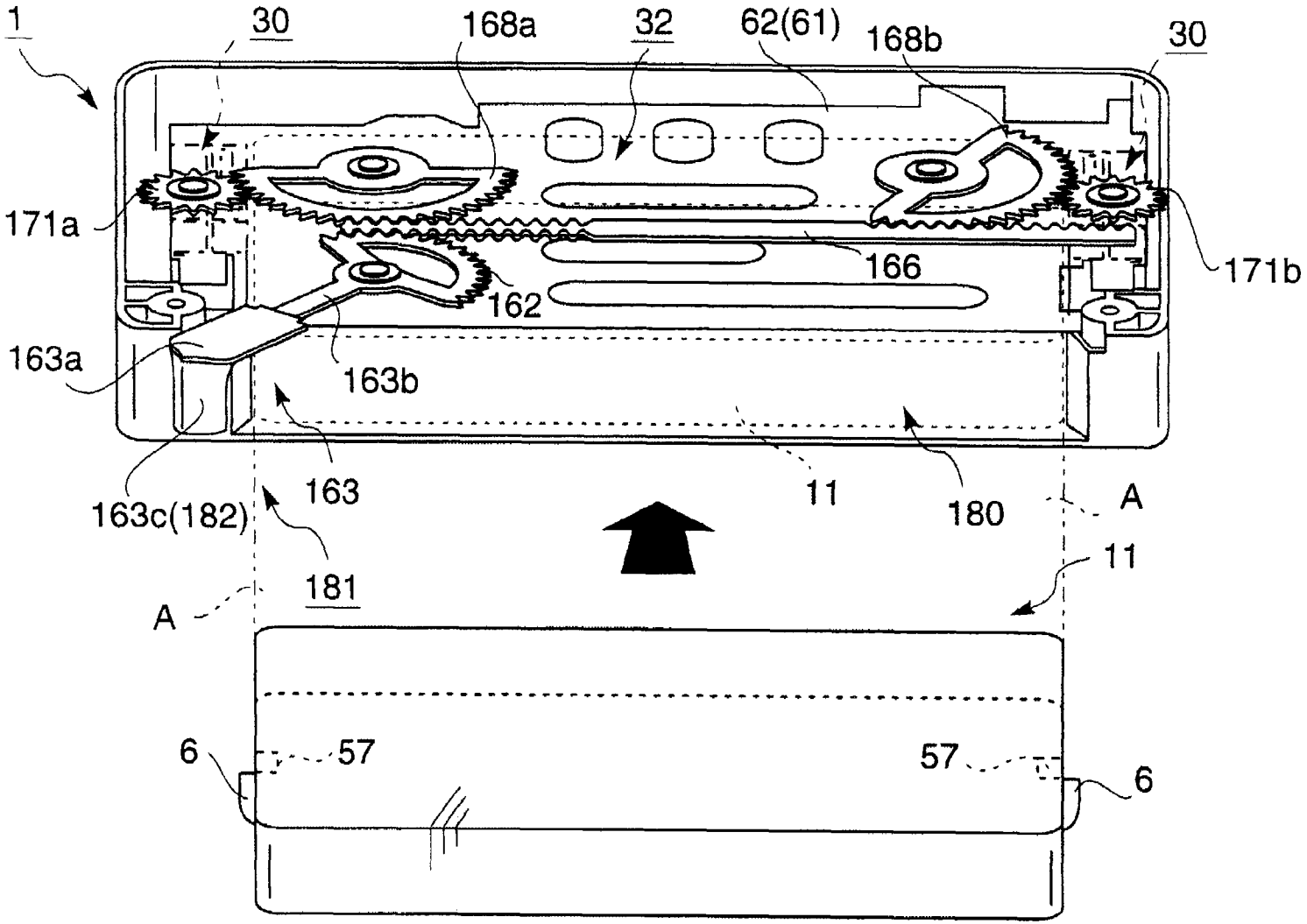
FIG. 18 is a rear perspective view showing an ink cartridge erroneous insertion action preventing unit when resetting according to an embodiment of the invention.
Figure 19:
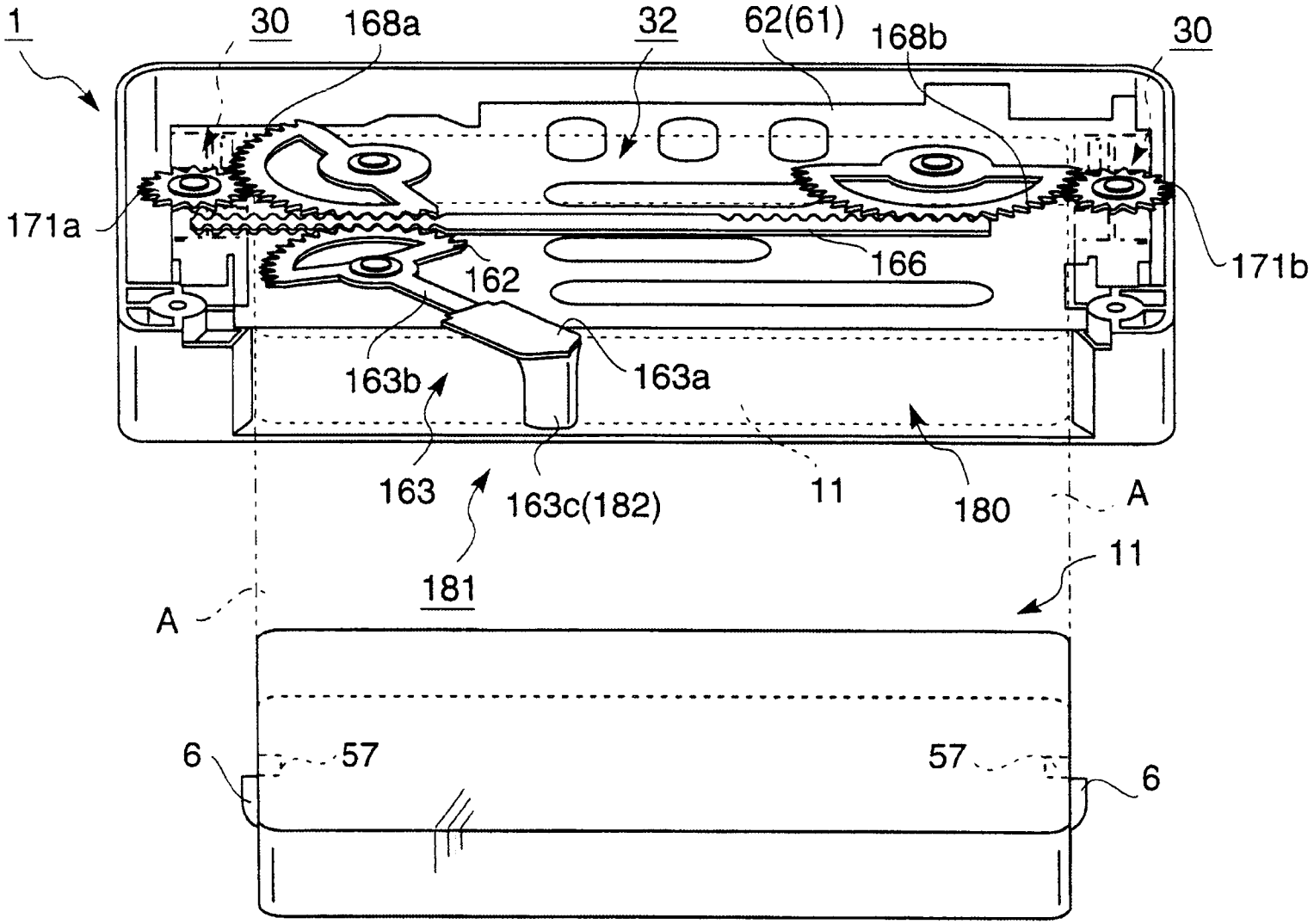
FIG. 19 is a rear perspective view showing an ink cartridge erroneous insertion action preventing unit when setting according to an embodiment of the invention.
Figure 20A:
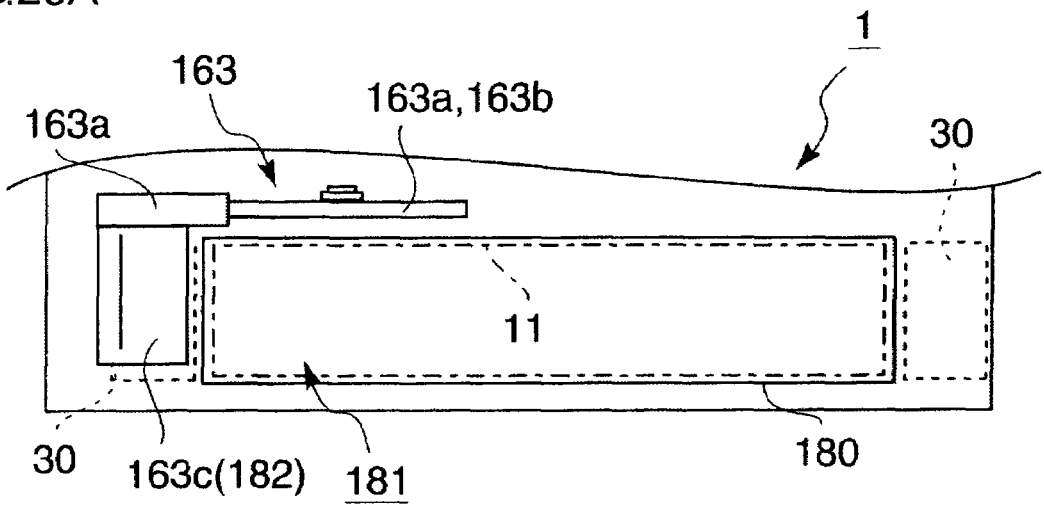
FIGS. 20A to 20C are rear views and a side view showing an ink cartridge erroneous insertion action preventing unit according to an embodiment of the invention.
Figure 20B:
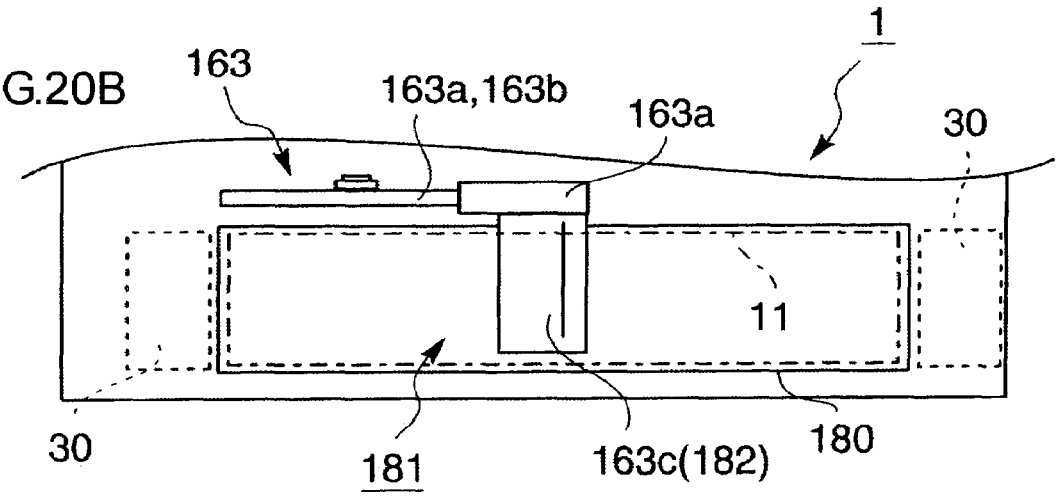
Figure 20C:
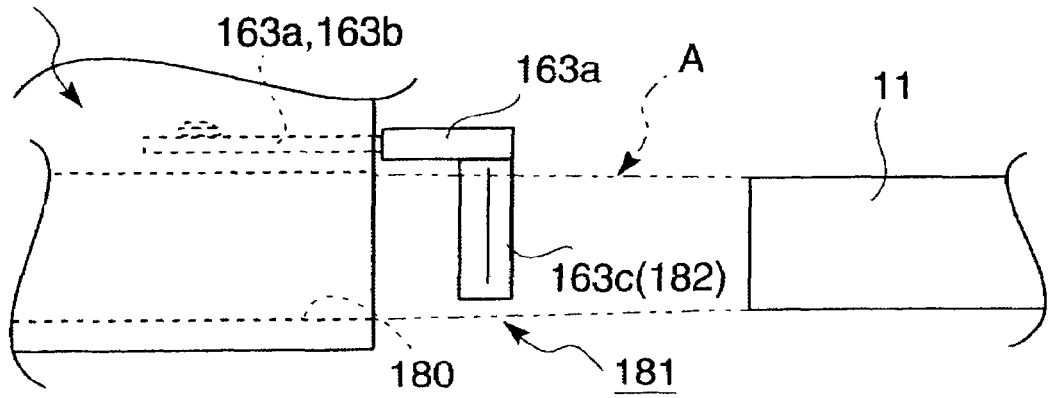
Figure 21:
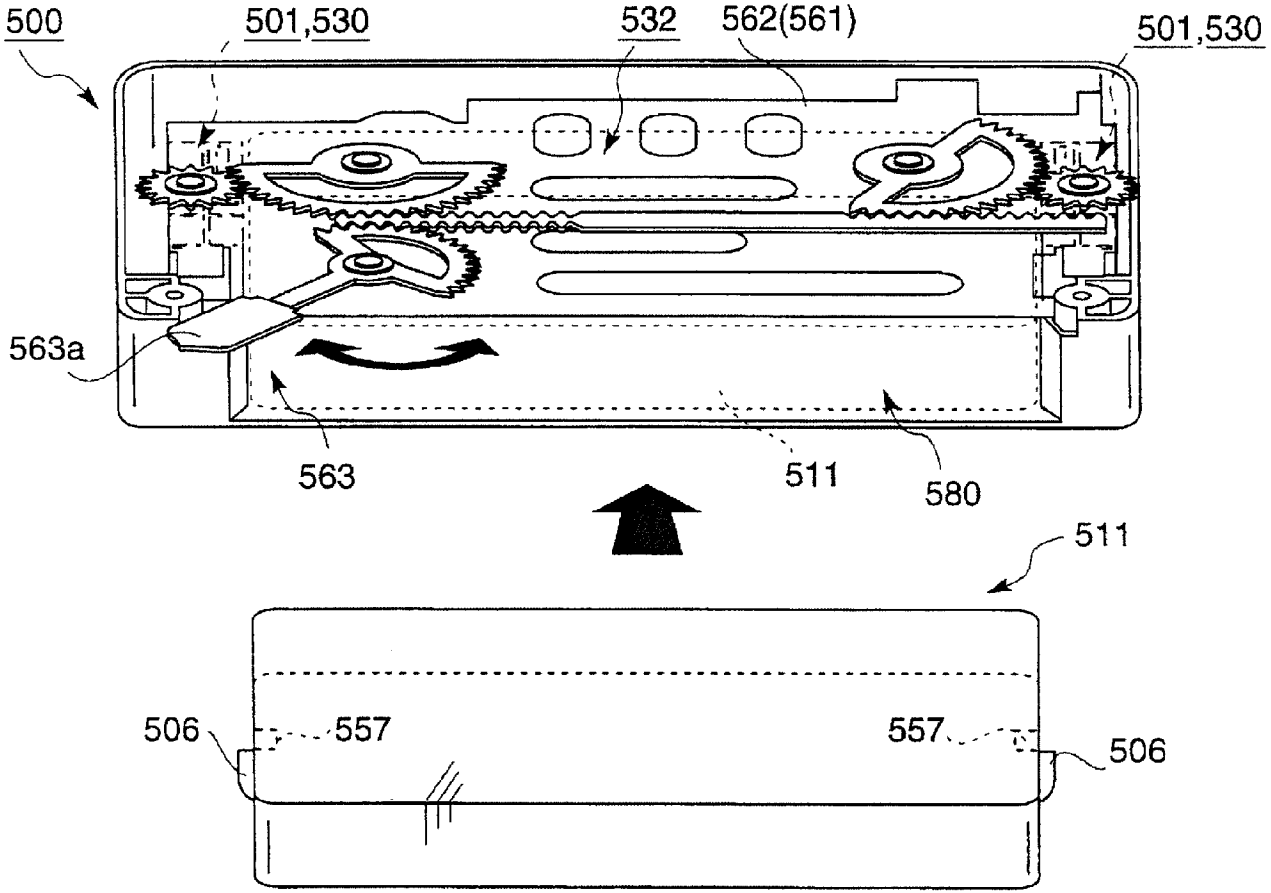
FIG. 21 is a rear perspective view showing an ink cartridge attachment/detachment device when resetting according to the related art.
Figure 22:
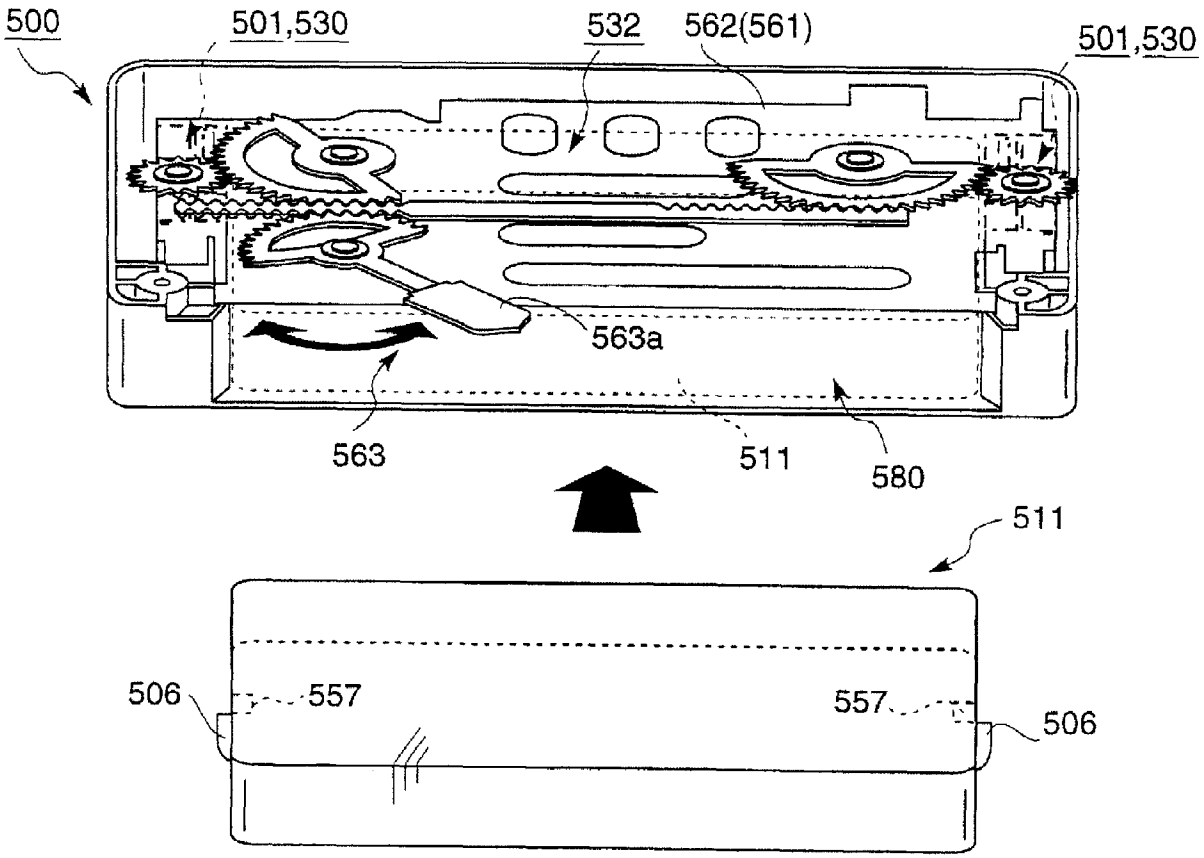
FIG. 22 is a rear perspective view showing an ink cartridge attachment/detachment device when setting according to the related art.
Figure 23:
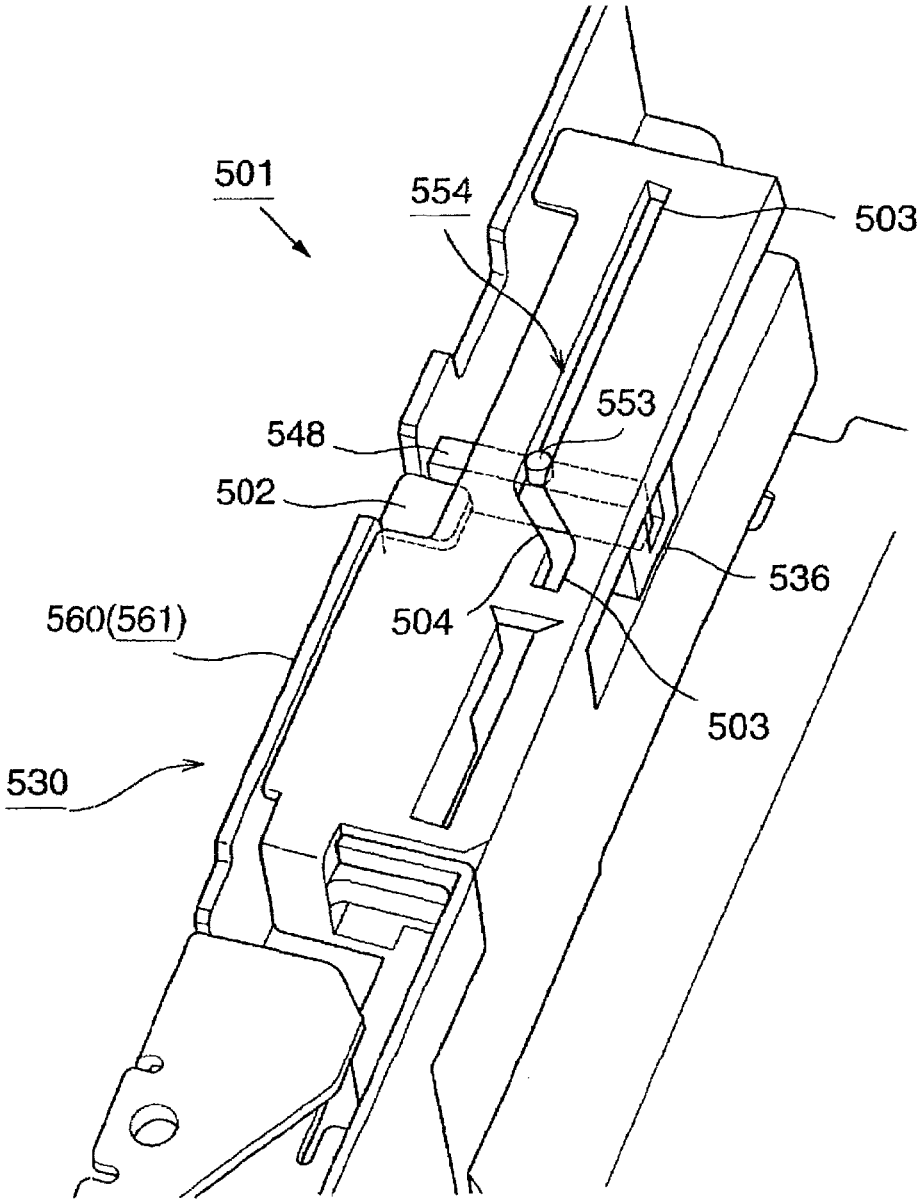
FIG. 23 is a perspective view showing an ink cartridge erroneous insertion preventing unit according to the related art.
Figures 24A, 24B:
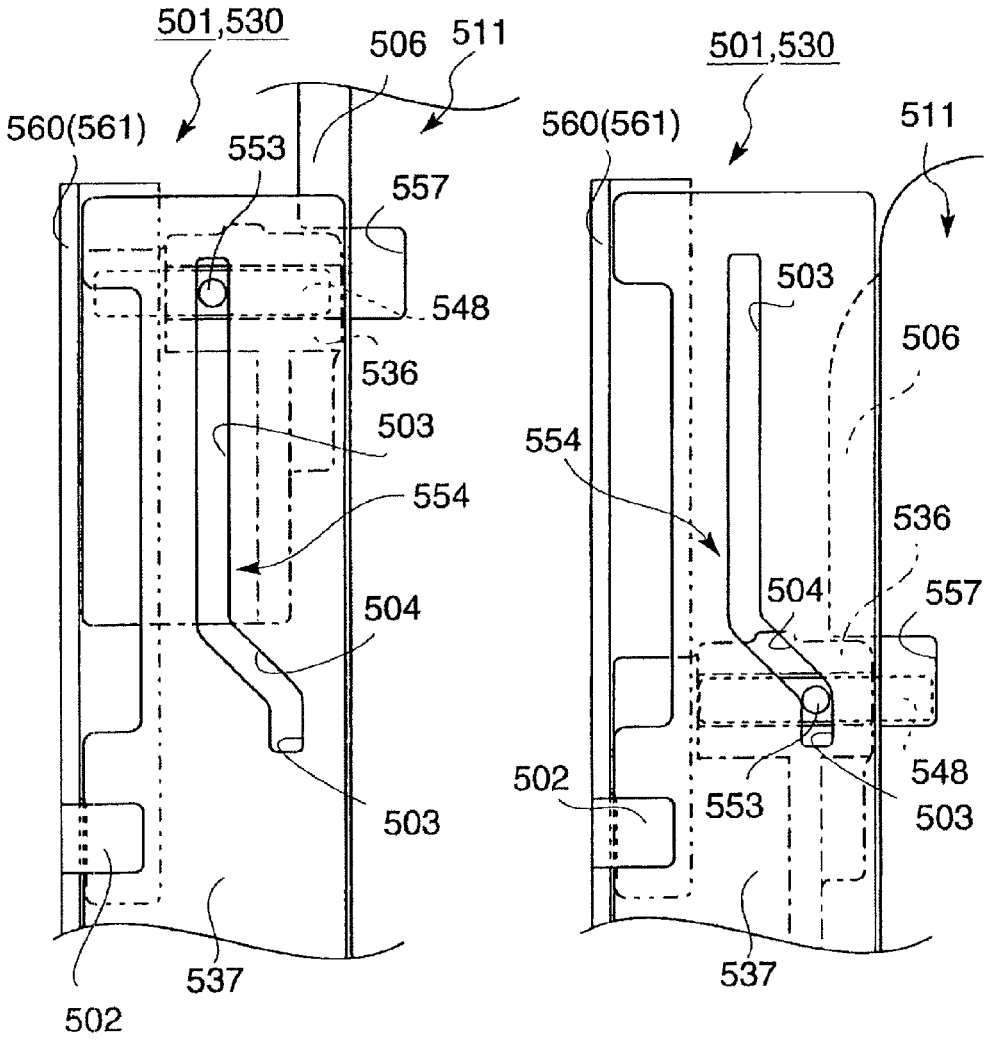
FIG.24B PRIOR ART
FIGS. 24A and 24B are bottom views showing the operation states of an ink cartridge erroneous insertion preventing unit upon typical insertion of an ink cartridge according to the related art.
Figure 25A:
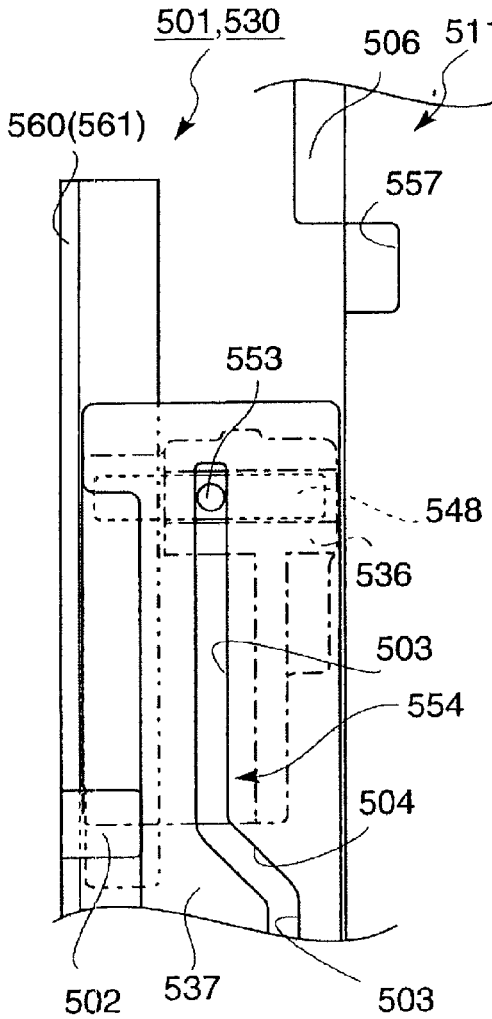
FIGS. 25A and 25B are bottom views showing the operation states of an ink cartridge erroneous insertion preventing unit upon erroneous insertion of an ink cartridge according to the related art.
Figure 25B:
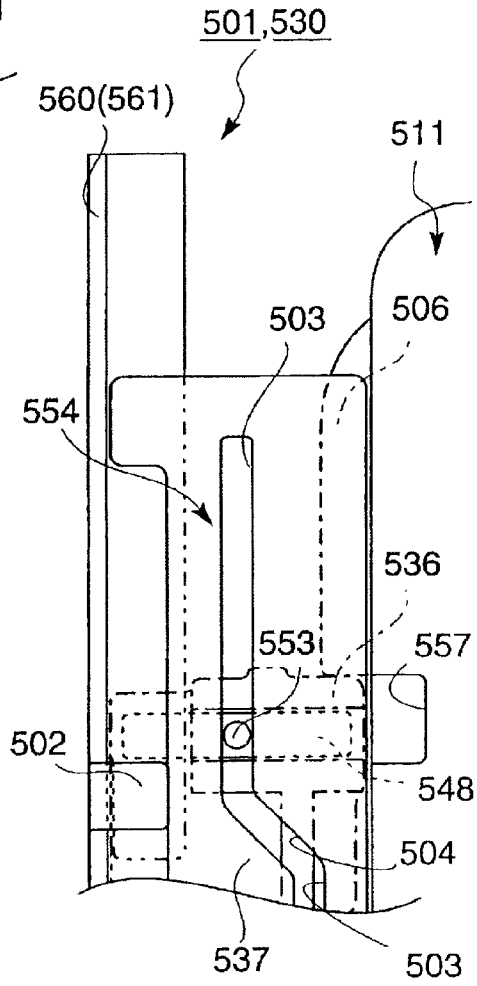
FIG.25B PRIOR ART

FIG. 18 is a rear perspective view showing an ink cartridge erroneous insertion action preventing unit upon reset according to the embodiment of the invention. FIG. 19 is a rear perspective view showing an ink cartridge erroneous insertion action preventing unit upon reset according to the embodiment of the invention. FIGS. 20A to 20C are rear views and a side view showing an ink cartridge erroneous insertion action preventing unit according to the embodiment of the invention.

Here, the position of the lever arm shown in FIG. 18 is the same as the position of the lever arm shown in FIG. 3, 5, or 9.

Meanwhile, the position of the lever arm shown in FIG. 19 is the same as the position of the lever arm shown in FIG. 13. Further, FIG. 20A is a rear view of FIG. 18, FIG. 20B is a rear view of FIG. 19, and FIG. 20C is a side view of FIG. 20B.

As shown in FIGS. 18 and 19, an insertion opening 180 is provided in the ink cartridge attachment/detachment device 1 such that the ink cartridge 11 is inserted into the main body of the recording apparatus through an approach path A. Here, the approach path A means a travel locus of the ink cartridge 11 into the inserting opening 180 when the ink cartridge 11 is inserted. Further, an ink cartridge erroneous insertion action preventing unit 181 is provided in the ink cartridge attachment/detachment device 1. The ink cartridge erroneous insertion action preventing unit 181 has the insertion opening 180, and a blocking member 182 that can block the approach path A from the outside of the main body 3 of the recording apparatus. In this embodiment, the blocking member 182 is a lever protrusion 163*c* that is formed in the knob 163*a* of the lever arm 163. Here, the lever protrusion 163*c* extends in a lateral direction of the insertion opening 180, and its length is ⅔ or more of the length in the lateral direction of the insertion opening 180. Therefore, when the lever arm 163 is located at a reset position shown in FIG. 18 or 20A, the lever protrusion 163*c* is retracted from the approach path A so as not to obstruct the insertion of the ink cartridge 11.

Meanwhile, when the lever arm 163 is located at a set position shown in FIG. 19, 20B, or 20C, the lever protrusion 163*c* is moved to a position opposing the substantially central portion of the insertion opening 180 so as to prevent the insertion of the ink cartridge 11 into the insertion opening 180.

Here, when the lever arm 163 is located at a position other than the reset position, that is, between the reset position and the set position, the lever protrusion 163*c* can oppose a part of the insertion opening 180 so as to block the approach path A. Therefore, like the case where the lever arm 163 is located at the set position, at this time, the insertion of the ink cartridge 11 can also be prevented.

As shown in FIG. 20C, although a gap is provided between the lever protrusion 163*c* and the insertion opening 180, the gap is provided small to an extent that the ink cartridge 11 may not be inserted from the gap. That is, there is no case where the ink cartridge 11 passes through the lower end of the lever protrusion 163*c* and is inserted from the gap.

The attachment/detachment device 1 of the ink cartridge 11 of this embodiment is the attachment/detachment device 1 of the ink cartridge 11 which loads the ink cartridge 11 into the main body 3 of the recording apparatus by sliding the ink cartridge 11. The attachment/detachment device 1 of the ink cartridge 11 includes the insertion opening 180 into which the ink cartridge 11 is inserted, the cartridge holding unit 30 that holds the ink cartridge 11 upon insertion of the ink cartridge 11 into the insertion opening 180 by the first predetermined stroke, the power transmitting and converting mechanism 32 that converts the rotation of the lever arm 163 into the movement of the second predetermined stroke S required for loading the ink cartridge 11 held by the cartridge holding unit 30, and the ink cartridge erroneous insertion action preventing unit 181 that prevents an insertion action of the ink cartridge 11 by a user when the lever arm 163 is located at the set position at which the lever arm 163 is supposed to be when loading of the ink cartridge 11 is completed or when the lever arm 163 is located at the position other than the reset position at which loading of the ink cartridge 11 is enabled.

As a result, when the lever arm 163 is located at the set position at which the lever arm 163 is supposed to be when loading of the ink cartridge 11 is completed or when the lever arm 163 is located at the position other than the reset position at which loading of the ink cartridge 11 is enabled, the insertion of the ink cartridge 11 by the user can be prevented. That is, since the erroneous insertion action itself can be prevented, the mechanisms in the recording apparatus are prevented from being damaged due to the erroneous insertion action.

The ink cartridge erroneous insertion action preventing unit 181 of this embodiment has the blocking member 182 that blocks the approach path A of the ink cartridge 11 to the insertion opening 180 upon the insertion of the ink cartridge 11 from the outside of the main body 3 of the recording apparatus. The blocking member 182 blocks the approach path A when the lever arm 163 is located at the set position or when the lever arm 163 is located at the position other then the reset position, and is retracted from the approach path A when the lever arm 163 is located at the reset position.

As a result, when the lever arm 163 is located at the set position or when the lever arm 163 is located at the position other than the reset position, the approach path A is blocked by the blocking member 182, and thus the user cannot insert the ink cartridge 11 into the insertion opening 180. At this time, since the approach path A is blocked by the blocking member 182, there is little possibility that the user tries to insert the ink cartridge 11. That is, the user visually checks whether the approach path A is blocked by the blocking member 182 and then judges whether or not to insert the ink cartridge 11.

The blocking member 182 blocks the insertion opening 180 from the outside of the main body 3 of the recording apparatus. That is, since the blocking member blocks the insertion opening 180 from the outside, not the inside, it is possible for the user to easily perform the visual check.

The blocking member 182 of this embodiment is the lever protrusion 163*c* which is a protrusion formed in the lever knob provided at one end of the lever arm 163.

As a result, the approach path A can be blocked by a simple configuration.

In this embodiment, the lever arm 163 rotates in the longitudinal direction of the insertion opening 180, and the lever protrusion 163*c* extends in the lateral direction of the insertion opening 180.

As a result, for example, when the lever arm 163 is located at the set position, the lever protrusion 163*c* can be located at the center of the insertion opening 180. Therefore, even though the lever protrusion 163*c* is provided comparatively short, the erroneous insertion of the ink cartridge 11 and the erroneous insertion action itself can be reliably prevented by locating the lever protrusion 163 at the center of the insertion opening 180.

OTHER EMBODIMENTS

Figure 26:
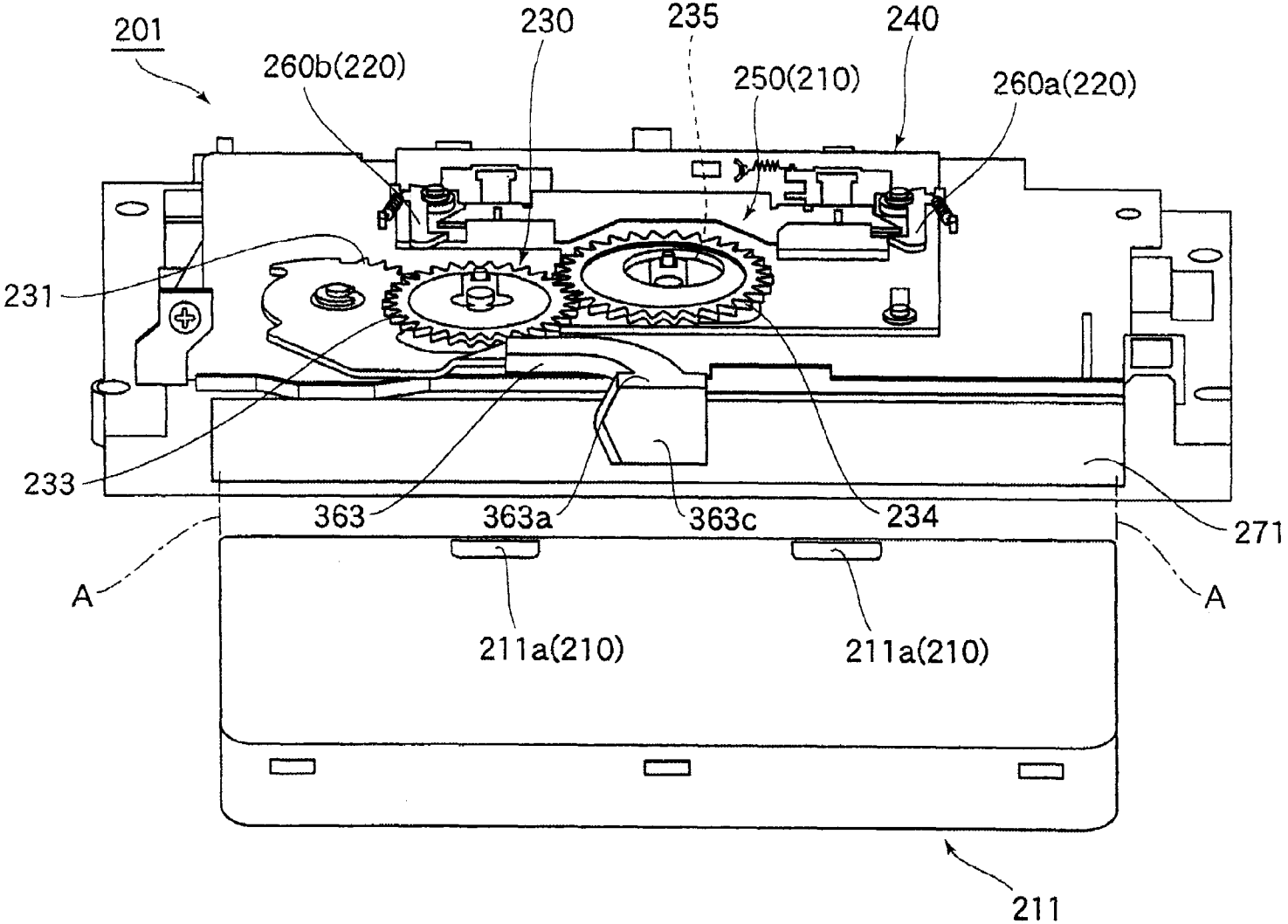
FIG. 26 is a rear perspective view showing an ink cartridge erroneous insertion action preventing unit when setting according to another embodiment of the invention.
Figure 27:
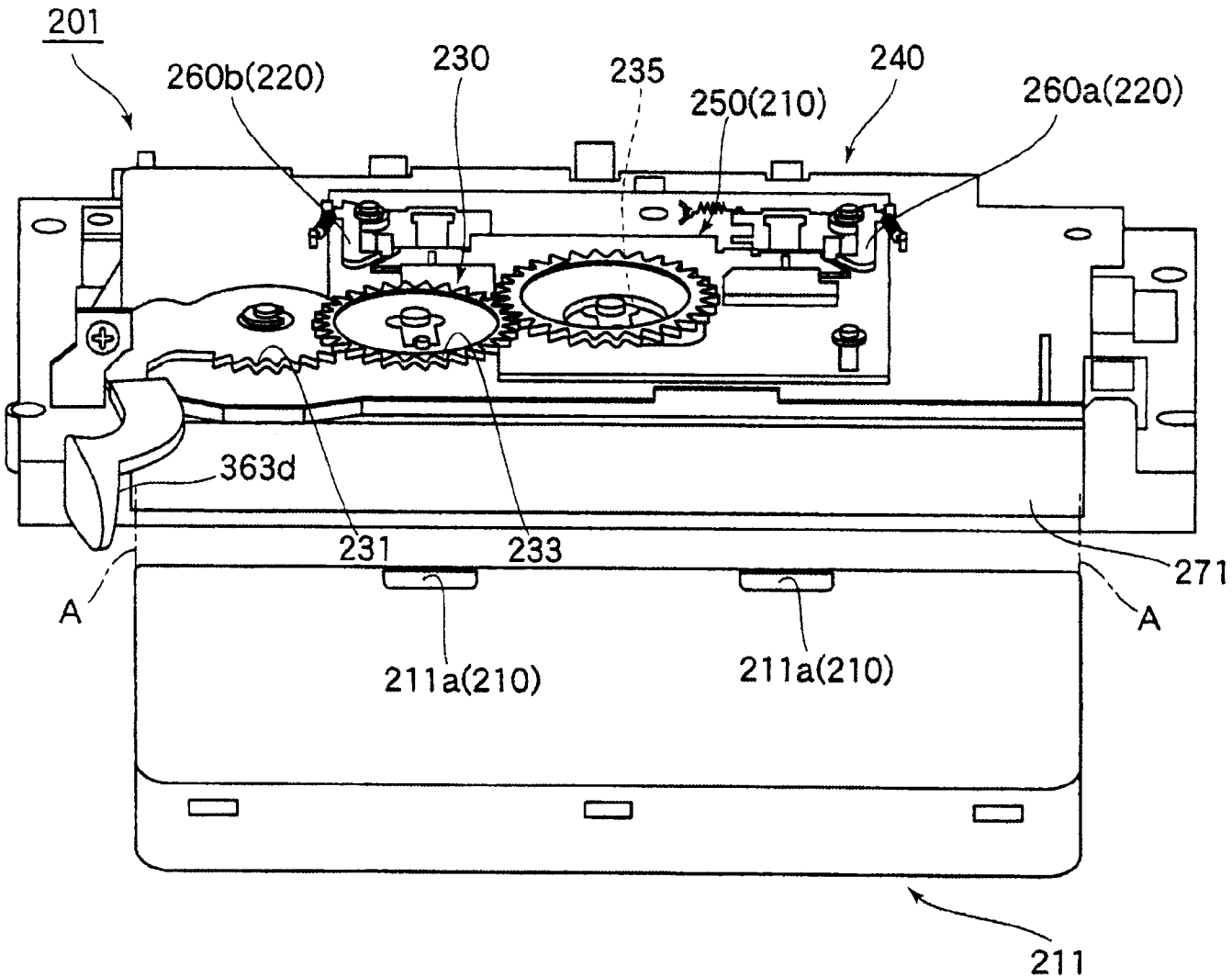
FIG. 27 is a rear perspective view showing an ink cartridge erroneous insertion action preventing unit when resetting according to another embodiment of the invention.
Figure 28:
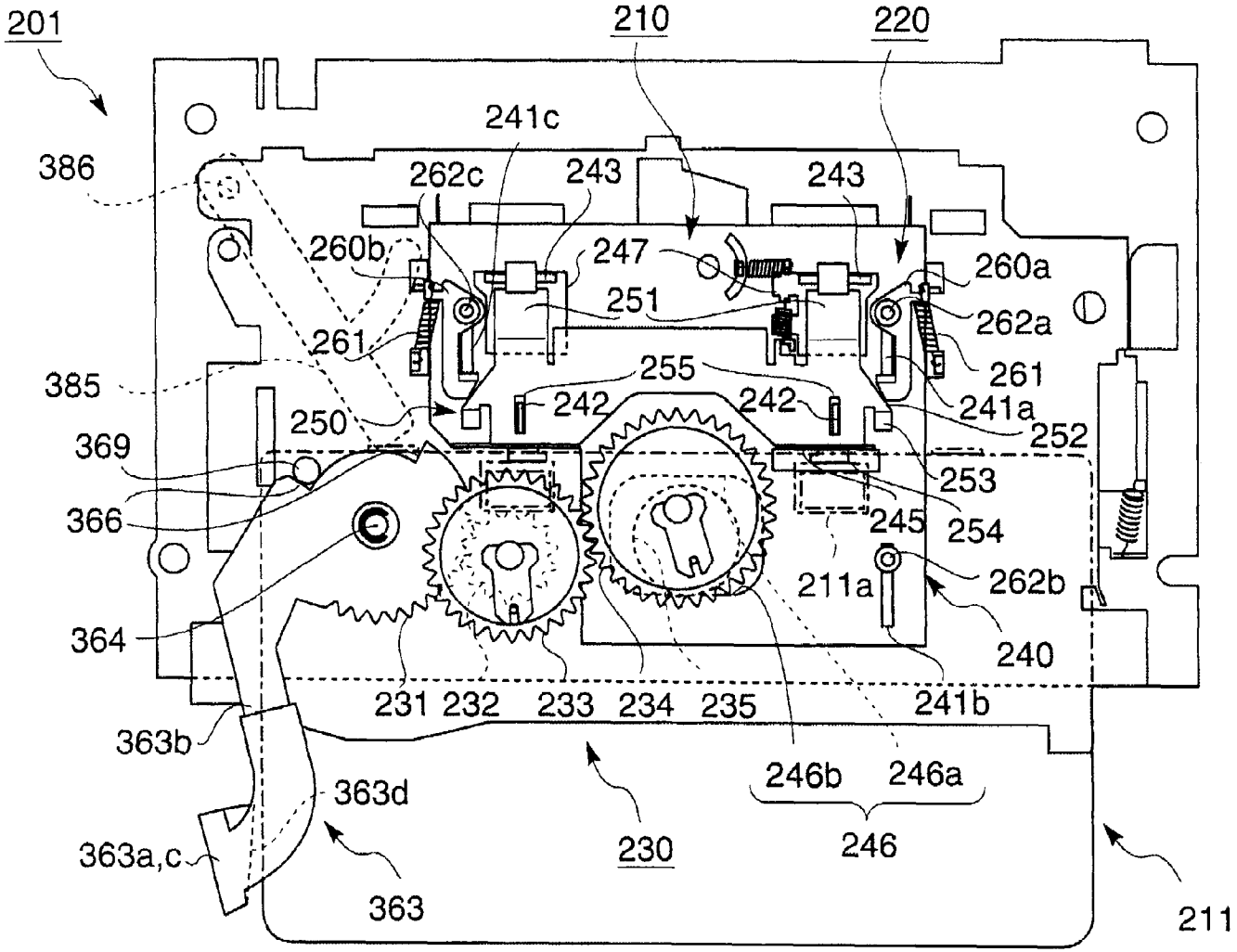
FIG. 28 is a plan view showing an ink cartridge erroneous insertion action preventing unit when resetting according to another embodiment of the invention.
Figure 29:
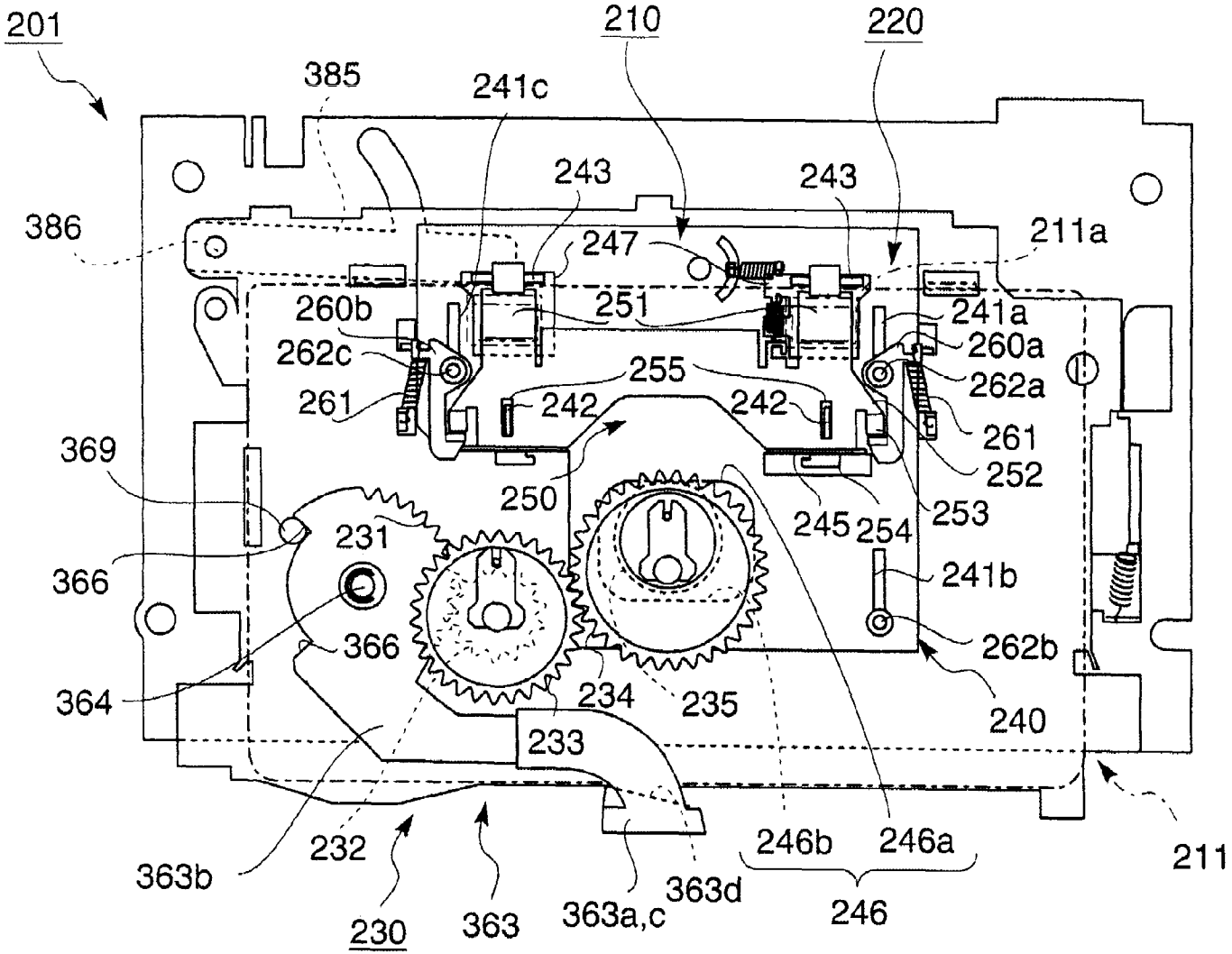
FIG. 29 is a plan view showing an ink cartridge erroneous insertion action preventing unit when setting according to another embodiment of the invention.

FIG. 26 is a rear perspective view showing an ink cartridge erroneous insertion action preventing unit when setting according to another embodiment of the invention. FIG. 27 shows an ink cartridge erroneous insertion action preventing unit when resetting in FIG. 26. FIG. 28 is a plan view showing when the ink cartridge is being inserted at the reset position of the lever arm. FIG. 29 is a plan view showing a state where loading of the ink cartridge is completed.

The structures shown in the drawings are different from that in the above-described embodiment, but an insertion method, a loading method and a discharge method of an ink cartridge 211, and an operation method of the set position and the reset position of a lever arm 363 are the same as those in the above-described embodiment.

First, a description will be given for the structure. An attachment/detachment device 201 of the ink cartridge 211 includes a power transmitting and converting mechanism 230, a cartridge holding unit 210, and an unlocking mechanism 220. Of these elements, the power transmitting and converting mechanism 230 has a lever arm 363, a first gear 231 that is provided in the lever arm 363, a second gear 232 that power-transmittably comes into contact with the first gear 231, a third gear 233 that is provided integrally with the second gear 232, a fourth gear 234 that power-transmittably comes into contact with the third gear 233, an eccentric cam 235 that is provided integrally with the fourth gear 234, and a slider portion 240 that serves as a cam follower to be brought into contact with the eccentric cam 235. A first slider opening 246 is provided in the slider portion 240. The eccentric cam 235 is brought or pressed into contact with a first face 246*a* or a second face 246*b* of the first slider opening 246, and the slider portion 240 can move in the load/discharge direction.

The cartridge holding unit 210 includes the slider portion 240 having a latch plate 250 with two pawls 251 in the attachment/detachment device, and two concave portions 211*a* which are engaged with the pawls 251 in the ink cartridge. The latch plate 250 is provided such that the pawls pivot relative to the slider portion 240 with a position where a latch plate engagement portion 254 opposite to the pawl 251 and a slider engagement portion 245 in the slider portion are engaged with each other. At this time, the latch plate 250 is disposed on the top face of the slider portion 240, and the two pawls 251 of the latch plate 250 are provided to protrude downward through two slider openings 247 of the slider portion 240.

The unlocking mechanism 220 has a slope portion 253 that is formed in the latch plate 250, and cancel arms 260*a* and 260*b* that are provided on both sides of the latch plate 250 in the load direction and are brought into contact with the slope portion 253 only when discharging the ink cartridge 211, to thereby push the latch plate 250 upward.

The detailed description of the structure will be given, together with the description of the operation of the attachment/detachment device 201.

In this embodiment, the slider portion 240 and the latch plate 250 are formed of metal plates in order that the position of the latch plate 250 is accurately, so-called rigidly, positioned.

Subsequently, the operation will be described according to the states of the insertion, loading, and discharge of the ink cartridge 211.

(1) Insertion

As shown in FIG. 28, first, the ink cartridge 211 is inserted into an insertion opening 271. At this time, a guide face 363*d* is provided in a lever protrusion 363*c* of a knob 363*a*, and the guide face 363*d* is provided to guide the ink cartridge 211 go the insertion opening 271 when the user inserts the ink cartridge 211 into the insertion opening 271 (see FIGS. 26 and 27). Specifically, the guide face 363*d* is provided obliquely relative to the load direction of the ink cartridge such that the ink cartridge 211 pushed out of the approach path A described above (the same description as that of FIGS. 18 and 19 is applied) is gradually pushed back to the approach path A as the ink cartridge 211 is close to the insertion opening 271. If a front end of the ink cartridge 211 is inserted into the insertion opening 271, the front end of the ink cartridge 211 is brought into contact with a discharge lever 385. The discharge lever 385 is provided to rotate with a discharge lever shaft 386 as a fulcrum and to be biased in the discharge direction of the ink cartridge 211 by a spring (not shown).

FIG. 28 shows a state where the ink cartridge 211 is in contact with the discharge lever 385 and stops. In this state, since the locus of the lever protrusion 363*c* is blocked by the side faces of the ink cartridge 211, the lever arm 363, which is located at the reset position, cannot be rotated to the set position. Therefore, a push-in operation of the ink cartridge 211 by the user in the load direction using the lever protrusion 363*c*, that is, an erroneous operation (abnormal operation) can be prevented.

If the ink cartridge 211 is pushed and inserted by the first predetermined stroke against biasing force of the discharge lever 385, the front end of the ink cartridge 211 is brought into contact with the pawls 251 protruding downward from a second slider opening 247 of the latch plate 250. Then, the front end of the ink cartridge 211 pushes the pawls 251 upward, and the two pawls 251 and the two concave portions 211*a* in the ink cartridge 211 are engaged with each other. That is, the slider portion 240 integrally holds the ink cartridge 211 through the latch plate 250. This state is an insertion completion state of the ink cartridge 211.

(2) Loading

Next, the ink cartridge 211 is loaded.

If the lever arm 363 rotates from the reset position shown in FIG. 28 in a counterclockwise direction with a lever strut 364 as a fulcrum, as described above, the first gear 231 transmits power to the second gear 232, and the third gear 233, which is provided integrally with the second gear 232, transmits power to the fourth gear 234. The eccentric cam 235, which is provided integrally with the fourth gear 234, is brought and pressed into contact with the first face 246*a* of the first slider opening 246 so as to move the slider portion 240 in the load direction. At this time, two guide slits 241*a* and 241*b* are provided in the slider portion 240, and shafts 262*a* and 262*b* are inserted into the guide slits 241*a* and 241*b*, such that the moving direction of the slider portion 240 is restricted.

If the slider portion 240 moves in the load direction, the ink cartridge 211 held by the pawls 251 of the latch plate 250 integrally moves. At this time, the engagement of the slider engagement portion 245 and the latch plate engagement portion 254 is loosened, and a slider protruding portion 242, which is provided in the slider portion and is engaged with a latch plate slit 255, presses the face of the latch plate slit 255 in the load direction. The pressing force is transmitted to the ink cartridge 211 through the pawls 251, and the ink cartridge 211 is moved in the load direction. The reason for this configuration is that, when a pivot fulcrum of the latch plate 250 is temporarily provided, large pressing force required for loading the ink cartridge 211 is centered on the fulcrum, and the fulcrum is deformed, which causes a problem in ensuring accuracy of the pressing force and distance when the ink cartridge 11 is pushed in. According to this embodiment of the invention, the fulcrum is not provided, and thus the pressing force and distance can be reliably ensured.

When the slider portion 240 moves in the load direction, a shoulder portion 252 provided in the slider portion 240 rotates the cancel arms 260*a* and 260*b* against biasing force of a cancel arm spring 261 with a shaft 262*c* inserted into a slit 241*c* and a shaft 262*a* inserted into the guide slit 241*a* as fulcrums. Then, if the shoulder portion 252 passes, the cancel arms 260*a* and 260*b* return to the original states by the biasing force of the cancel arm spring 261. The cancel arms 260*a* and 260*b* are members which work on the latch plate 250 when the ink cartridge 211 is discharged, and the description thereof will be given below.

If the lever arm 363 is rotated in the counterclockwise direction and is operated to the set position, loading of the ink cartridge 211 is completed (loading completion state), as shown in FIG. 29.

(3) Discharge

When discharging, the lever arm 363 is rotated from the set position shown in FIG. 29 to the reset position shown in FIG. 28 in a clockwise direction.

If the lever arm 363 is rotated in the clockwise direction, power of the lever arm 363 is transmitted to the eccentric cam 235, as described above. Then, the eccentric cam 235 is brought and pressed into contact with the second face 246*b* of the first slider opening 246 and moves the slider portion 240 in the discharge direction. At this time, an abutting portion 243 provided in the slider portion 240 is brought and pressed into contact with the front end of the ink cartridge 211 and moves the ink cartridge 211 in the discharge direction, together with the slider portion 240. If the slider portion 240 is moved in the discharge direction, the slope portion 253 provided in the latch plate 250 gradually runs onto the cancel arms 260*a* and 260*b*. Then, the latch plate 250 pivots upward with a position where the slider engagement portion 245 and the latch plate engagement portion 254 are engaged with each other. Therefore, the engagement of the pawls 251 in the latch plate and the concave portions 211*a* in the ink cartridge 211 is released. At this time, since the ink supply needles are pulled out of the ink cartridge 211, the ink cartridge 211 is discharged from the insertion opening 271 by the biasing force of the above-described discharge lever 385.

Subsequently, if the lever arm 363 is rotated in the clockwise direction further, the slope portion 253 runs over the cancel arms 260*a* and 260*b*, and thus the pawls 251 pivot downward again. Then, as shown in FIG. 27, the lever arm 363 is located at the reset position again.

A rotation fulcrum of the lever arm 363 is provided at a position offset with respect to the center of the insertion opening 271 in the longitudinal direction of the insertion opening 271. Therefore, the lever protrusion 363*c* can be provided such that the moving direction of the lever protrusion 363*c* during the rotation of the lever arm 363 from the set position to the reset position is gradually apart from the insertion opening 271 in the discharge direction of the ink cartridge 211. That is, when discharging the ink cartridge 211, the lever protrusion 363*c* can be provided such that the moving direction of the lever protrusion 363*c* is not inverted along the insertion/discharge direction of the ink cartridge 211. As a result, when the ink cartridge 211 is discharged, there is little possibility that the lever protrusion 363*c* pushes back the ink cartridge 211, which moves in the discharge direction, in the insertion direction opposite to the discharge direction.

Here, the degree of 'inclination' of the rotation fulcrum of the lever arm 363 may be set not to cause the moving direction of the lever protrusion 363*c* to be inverted along the insertion/discharge direction and the ink cartridge 211 to be pushed back and then held by the cartridge holding unit 210. That is, if the lever protrusion 363*c* slightly pushes back the ink cartridge 211, it does not matter.

Figure 30A:
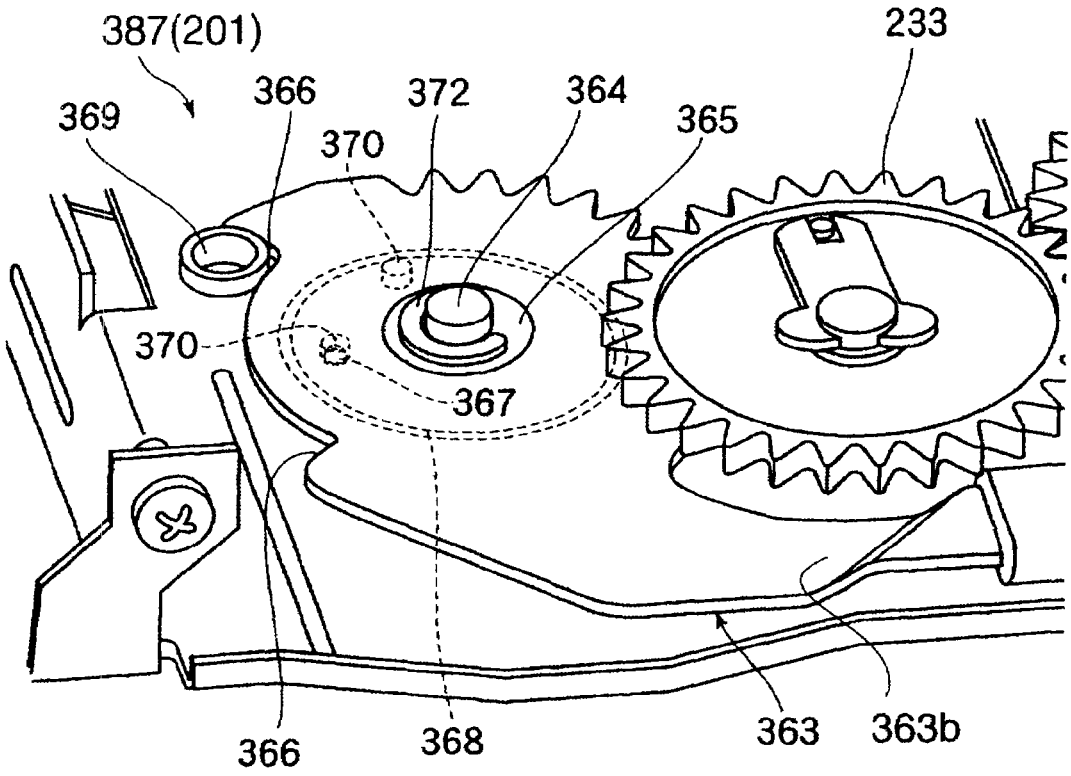
FIGS. 30A and 30B are enlarged views showing a lever fulcrum according to another embodiment of the invention.
Figure 30B:
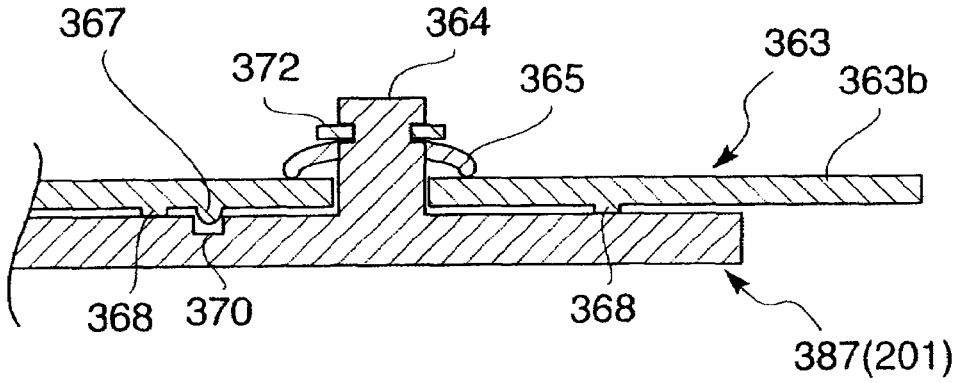

FIGS. 30A and 30EB are enlarged views of the lever fulcrum. FIG. 30A is a perspective view and FIG. 30B is a side cross-sectional view of the lever fulcrum.

As shown in FIG. 30A, in a base 387 of the attachment/detachment device main body (201) of the ink cartridge 211, a lever rotation restricting protrusion 369 is provided to restrict the rotation of the lever arm 363. Meanwhile, a lever rotation restricting portion 366, which is brought into contact with the lever rotation restricting protrusion 369 and restricts the lever arm 363 to rotate only between the set position and the reset position, is provided in the lever arm.

One positioning protrusion 367, which serves as a first engagement portion, is provided in the lever arm. Two holes 370, which serve as second engagement portions to be engaged with the positioning protrusion 367, are provided in the attachment/detachment device main body. The positions of the positioning protrusion 367 and the holes 370 are provided such that the user can obtain an operation feeling (click feeling) of 'click, click' with the engagement of the positioning protrusion 367 and the holes 370 when the lever arm 363 is being located at the set position and the reset position. Therefore, when the user operates the lever arm 363, the user can rotate the lever arm 363 to the set position and the reset position, without stopping at the intermediate position halfway.

With the engagement of the positioning protrusion 367 and the holes 370, the position of the lever arm 363 can be stabilized at the set position and the reset position.

As shown in FIG. 30B, the lever arm 363 is attached to the lever strut 364 by an E link 372 through a U spring washer 365. The U spring washer 365 is provided to bias the lever arm 363 toward the attachment/detachment device main body. Therefore, the operation feeling (click feeling) of 'click, click' when the positioning protrusion 367 is engaged with the hole 370 or the engagement is released can be adjusted at a proper strength.

If the front end of the positioning protrusion 367 is rounded, in a state where the positioning protrusion 367 is located in the vicinity of the hole, that is, in a state immediately before the positioning protrusion 367 is engaged with the hole 370, with the engagement of the positioning protrusion 367 and the hole 370, the lever arm 363 can be rotated to the accurate set position and reset position by biasing force of the U spring washer 365.

With the positioning protrusion 367 and the U spring washer 365, there is a possibility that the axial direction of the rotation fulcrum of the lever arm 363 is inclined relative to the axial direction of the lever strut 364. That is, if the lever arm 363 is rotated, an arm main body 363*b* considerably rubs against the base 387 of the attachment/detachment device main body (201). At worst, they may be scraped off and dusts may occur. For this reason, a circular rib 368 is provided in the lever arm 363 outside the positioning protrusion 367 with the lever strut 364 as a center. The height of the circular rib 368 is set to be lower than the positioning protrusion 367 so as not to obstruct the engagement of the positioning protrusion 367 and the holes 370. With the circular rib 368, the lever arm 363 and the base 387 can be brought into contact with each other at a position close to the rotation fulcrum of the lever arm 363, and the occurrence of large friction between the arm main body 363*b* and the base 387 at a position distant from the rotation fulcrum can be prevented. That is, the circular rib 368 restricts the rotation fulcrum of the lever arm to be inclined relative to the lever strut 364. The friction amount can be made small by reducing a rotation radius at a contact place. Therefore, an occurrence possibility of dusts described above can be markedly reduced.

In this embodiment, the first engagement portion is the positioning protrusion 367 and the second engagement portion is the holes 370, but the positioning protrusion 367 and the holes 370 may be configured inversely.

Further, although the circular rib 368 is provided in the lever arm (363), the circular rib 368 may be provided in the base 387 of the attachment/detachment device.

Figure 31B:
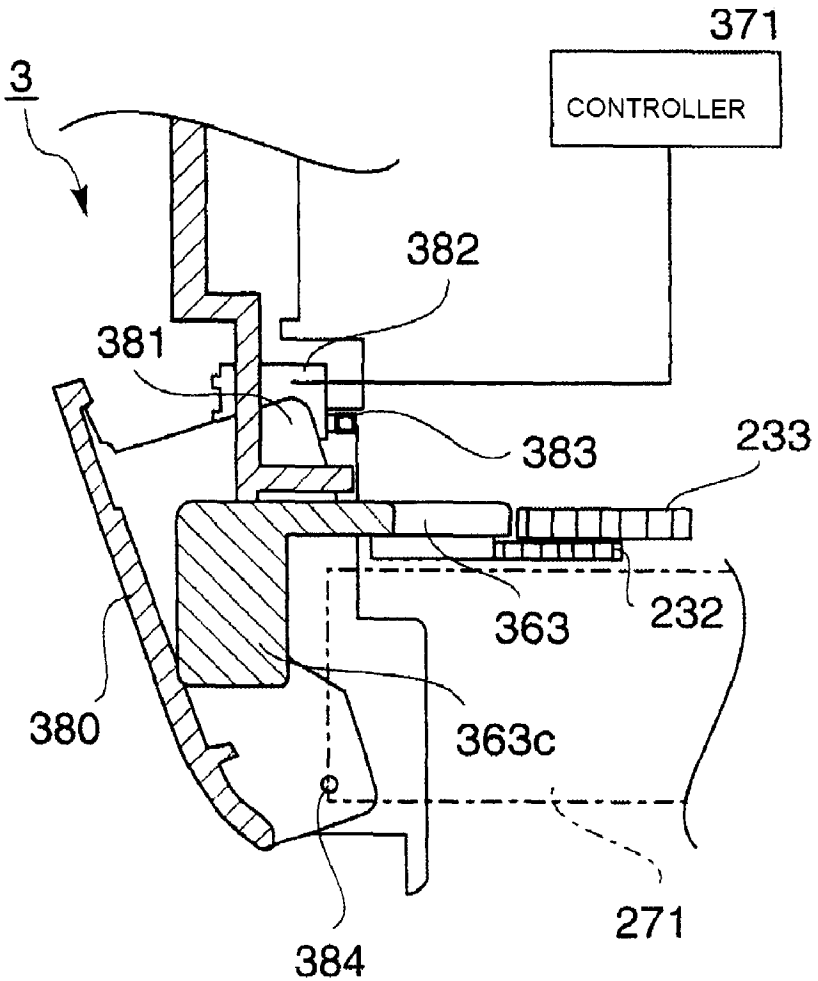
FIGS. 31A and 31B are side cross-sectional views showing a protrusion of a lever and a lid member according to another embodiment of the invention.
Figure 31A:
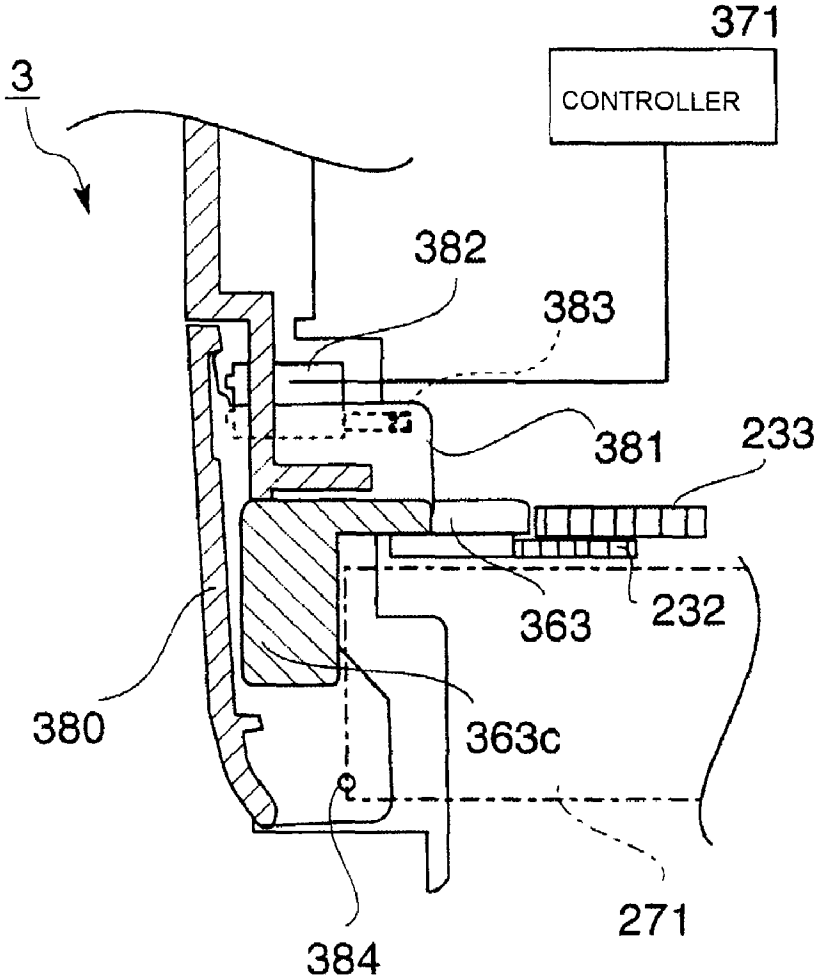

FIGS. 31A and 31B are side cross-sectional views showing a lever protrusion and a lid member. FIG. 31A shows a state where the lever arm is located at the set position, and FIG. 31B shows a state where the lever arm is located at a position other than the set position.

As shown in FIGS. 31A and 31B, a lid member 380 is provided outside the insertion opening 271. The lid member 380 can rotate around a lid rotation fulcrum 384 and openably cover the insertion opening 271. A lid sensor 382, which detects opening/closing of the lid member 380, is provided on a side opposite to the lid rotation fulcrum 384 of the insertion opening 271, that is, on an upper side than the insertion opening 271.

As shown in FIG. 31A, when the lever arm 363 is located at the set position, the lid member 380 can be closed. If the lid member 380 is closed, a lid window 381 is brought into contact with a sensor lever 383 of the lid sensor 382 and presses the sensor lever 383. Then, the lid sensor 382 detects; closing of the lid member and transmits a signal to the controller 371. The controller 371, which receives the signal, can progress the operation such as recording execution and so on.

Meanwhile, as shown in FIG. 31B, in a state where the lever arm 363 is located at a position other than the set position, the lever protrusion, which extends toward the lid rotation fulcrum, is brought into contact with the lie member 380. Accordingly, the lid member 380 may not be completely closed. In a state where the lid member 380 is opened a little, the lid window 381 provided in the lid member 380 is spaced apart from the sensor lever 383 of the lid sensor 382, and thus the lid sensor 382 does not transmit the signal to the controller 371. That is, since the lever protrusion extends toward the lid rotation fulcrum, in a state where the lever arm 363 is located at a position other than the set position, that is, loading of the ink cartridge 211 is not completed, there is little possibility that the lid sensor 382 erroneously detects closing of the lid member.

Although the blocking member is the lever protrusion in this embodiment, the blocking member is not limited to the protrusion.

The invention is not limited to the above-described embodiments, but various modifications, which still fall within the scope of the invention, can be made within the scope of the invention read on the appended claims.

What is claimed is:

1. An ink cartridge attachment/detachment device adapted to load an ink cartridge into an apparatus provided with an insertion opening, the device comprising:

a cartridge holding unit, holding the ink cartridge inserted into the apparatus from the insertion opening by a first stroke;

a lever arm, movable between a reset position at which the lever arm is supposed to be when a loading of the ink cartridge is enabled and a set position at which the lever arm is supposed to be when the loading of the ink cartridge is completed;

a power transmitting and converting mechanism, configured to convert a rotation of the lever arm into a movement of a second stroke required for loading the ink cartridge held by the cartridge holding unit; and an ink cartridge erroneous insertion action preventing unit, configured to prevent the ink cartridge from being inserted into the insertion opening when the lever arm is not at the reset position, wherein the ink cartridge erroneous insertion action preventing unit includes a blocking member, configured to be placed in an outside of the insertion opening so as to block the insertion of the ink cartridge into the insertion opening when the lever arm is not at the reset position, and configured to be retracted from the insertion opening when the lever arm is at the reset position.

2. The ink cartridge attachment/detachment device according to claim 1, wherein the lever arm is provided with a lever knob at one end side thereof, and the blocking member is a protrusion provided at a side of the lever knob of the lever arm.

3. The ink cartridge attachment/detachment device according to claim 2, wherein the protrusion is provided with a guide face guiding the ink cartridge to the insertion opening when the lever arm is positioned at the reset position.

4. The ink cartridge attachment/detachment device according to claim 2, wherein the lever arm rotates in a first direction parallel to a longitudinal direction of the insertion opening, and the protrusion extends in a second direction perpendicular to the first direction.

5. The ink cartridge attachment/detachment device according to claim 4, wherein the protrusion is arranged to block half or more of the insertion opening in the second direction.

6. The ink cartridge attachment/detachment device according to claim 4, wherein the protrusion is positioned at a center of the insertion opening in the first direction, when the lever arm is positioned at the set position.

7. The ink cartridge attachment/detachment device according to claim 4, wherein a rotation fulcrum of the lever arm is provided at a position offset a center of the insertion opening in the first direction.

8. The ink cartridge attachment/detachment device according to claim 4, wherein, before the ink cartridge is held by the cartridge holding unit, the protrusion of the lever arm is restricted by a side face of the ink cartridge extending to an insertion direction such that a rotation of the lever arm from the reset position to the set position is restricted.

9. The ink cartridge attachment/detachment device according to claim 4, wherein the protrusion is arranged to be brought into contact with a lid member, openably rotating to cover the insertion opening, so as to prevent the lid member from closing the insertion opening when the lever arm is not positioned at the set position.

10. The ink cartridge attachment/detachment device according to claim 1, wherein the lever arm is provided with a first engagement portion, adapted to be engaged with a second engagement portion provided in the attachment/detachment device when the lever arm is positioned at the set position or the reset position.

11. The ink cartridge attachment/detachment device according to claim 1, wherein a circular rib is provided in the lever arm or the attachment/detachment device in the vicinity of a rotation fulcrum of the lever arm with the rotation fulcrum as a center.

12. A recording apparatus operable to perform recording with respect to a recording medium with ink supplied from an ink cartridge, the recording apparatus comprising the ink cartridge attachment/detachment device according to claim 1 as the apparatus provided with the insertion opening.

13. An ink ejection apparatus operable to eject ink supplied from an ink cartridge toward a target medium, the ink ejection apparatus comprising the ink cartridge attachment/detachment device according to claim 1 as the apparatus provided with the insertion opening.

* * * * *